US005713162A

United States Patent [19]

Gallo et al.

[11] Patent Number: 5,713,162

[45] Date of Patent: Feb. 3, 1998

[54] ASEISMATIC SYSTEM FOR CONSTRUCTIONS SUCH AS BUILDINGS, DRY BRIDGES, TANKS AND LIKE

[76] Inventors: Pellegrino Gallo, No. 3, Via Eleonora Duse—00197; Franco Braga, No. 18, Via Pompeo Neri—00191, both of Rome, Italy

[21] Appl. No.: 572,758

[22] Filed: Dec. 14, 1995

[30] Foreign Application Priority Data

Dec. 19, 1994 [IT] Italy ..... RM94A0817

[51] Int. Cl.[6] ..... E02D 27/34

[52] U.S. Cl. ..... 52/167.1; 52/167.6

[58] Field of Search ..... 52/167.1, 167.6, 52/167.2, 167.8

[56] References Cited

U.S. PATENT DOCUMENTS 4,577,826 3/1986 Bergstrom et al. ..... 52/167.1
5,115,615 5/1992 Miyake et al. ..... 52/167.1
5,259,159 11/1993 Kawase et al. ..... 52/167.1
5,386,671 2/1995 Hu et al. ..... 52/721.3 X

*Primary Examiner*—Creighton Smith
*Attorney, Agent, or Firm*—Barnes, Kisselle, Raisch, Choate, Whittemore & Hulbert

[57] ABSTRACT

An aseismatic system for constructions such as buildings, bridges, tanks and like comprising abutment/decoupling means for the deck structure from the piers or for the building from its foundation as well as return means for resisting any relative displacements between the deck structure and the piers or between the building and its foundation, which is based upon the principle to prevent the bridge or the building to be subjected to the seismic effects caused by the deck structure mass by decoupling the construction on the horizontal plane by means of said multi-directional movable abutment means, with nearly null resistance to sliding movements and by means of a connection between the deck structure and its abutment members based upon a swinging device adapt to exert a predetermined action of constant value.

16 Claims, 36 Drawing Sheets

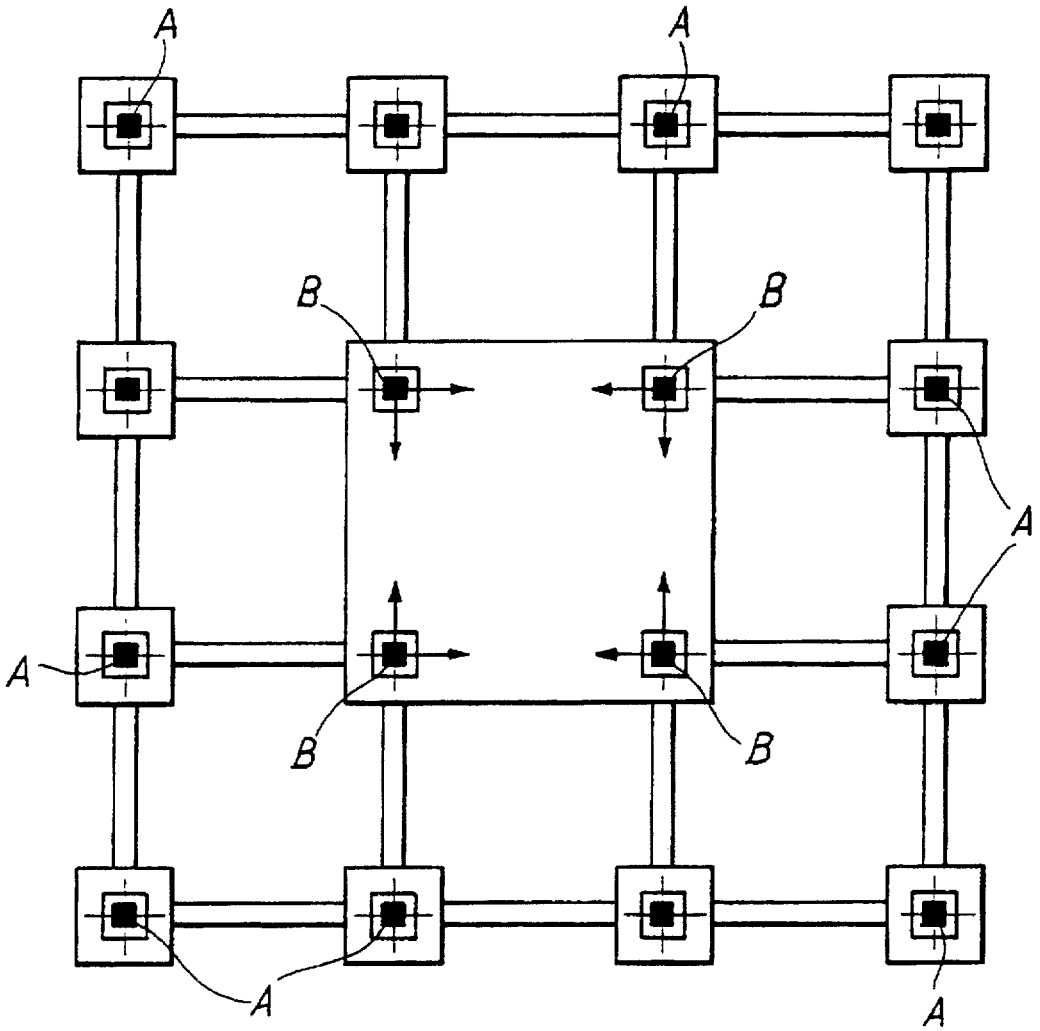
FIG. 12
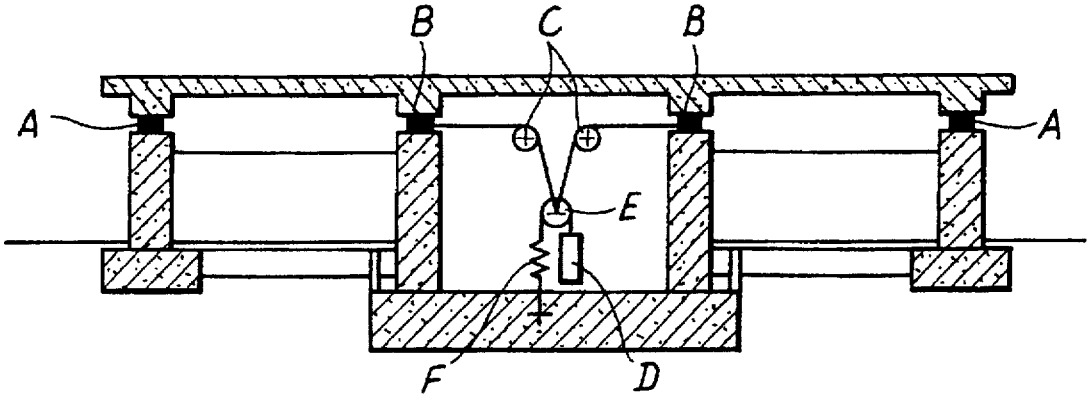

ASEISMATIC SYSTEM FOR CONSTRUCTIONS SUCH AS BUILDINGS, DRY BRIDGES, TANKS AND LIKE

This invention relates to an aseismatic system for buildings, as well as for dry bridges, tanks and anyway for all kinds of constructions characterized by the presence of a noticeable mass resting on the top of a column member.

More particularly, this invention relates to an aseismatic system comprising a set of mechanisms adapted to make the construction free from any seismic effects.

When it is desired to avoid seismic effects particularly upon a dry bridge, systems are presently known which comprise a set of energy dissipating devices as well as support devices of dissipative or decoupling type, but all these means have noticeable drawbacks because the concerned constructions and all aseismatic equipment connected therewith are anyway subject to the seismic event.

At present, all devices employed to protect the constructions in respect of the seismic events are mainly based upon two concepts: in the first place, to dissipate a certain fraction of the energy associated to the seismic forces and, in the second place, to modify the intrinsic oscillation period of the construction by decoupling its movements from any ground movements. Usually, both concepts are exploited in presently existing devices, combined in various proportions.

All these applications, however, successfully solve only some aspects of these complex seismic problems, but appear to be of no success in solving other aspects thereof. In fact, all devices based upon dissipation of energy, as usually used in the bridge field, are not in a position to avoid oversizing the construction in order to cope with a nominal forecast seismic event, and, when they are subjected to a seismic event of greater relevance, they are certainly adapted to reduce the first occurring effects, but they plastically collapse after a few oscillations, thereby leaving the construction without defence and its support and anti-seismic equipment unoperative. On the other side, all devices based upon decoupling the construction from the ground, as broadly even if randomly adopted in buildings, cannot avoid oversizing the construction in order to cope with any nominally forecast seismic event and have many drawbacks of twofold kind: the time limited maintainment of the mechanical properties of the generally used materials (elastomers) and the excessively large movements of the building body, with resulting damages thereto, and, in the case of a seismic event of high relevance with respect to those forecast in designing the construction, with unavoidable failure of the aseismatic devices themselves.

Other approaches based upon different principles wherein the resilient and/or friction properties are exploited are complex and very inefficient.

The approach proposed by this invention, in contrast, copes with the problem at its root. The approach according to this invention is adapted to decouple the building from its foundations and the deck structure of a bridge from its piers and shoulder in complete manner, while their mutual positions are at once controlled; it allows even the largest relative displacements caused by the shakes without the risk of damaging the equipment itself or the construction provided with it; it remains operative and efficient even in respect of a seismic event of higher grade with respect of those forecast in designing the construction; it is adapted to absorb an undefined number of large relative displacements; it has no duration problems in connection with its materials and, lastly, it does not require that the construction be seismically oversized. In fact, in the prior art, aiming at resisting the seismic effects, the constructions are noticeably oversized, but this approach, as above mentioned, does not guarantee an efficient solution of the problem, while it significantly increases the construction costs.

It is now clear that the need exists of an aseismatic system, designed for use in buildings, bridges and tanks, adapted to furnish a suitable response to the effects of a seismic events and to the problem of oversizing the construction and of the relatively increase of costs connected therewith.

To fulfil this requirement, it is proposed, according to this invention, to adopt a system which, in addition to making the construction and its bearing, junction and structural finishing equipment free from the seismic effects, even if the seismic event is of a higher grade with respect to any seismic event forecast in designing the constructions, is also adapted to avoid the need of seismically oversizing it, as it usually occurs with apparent cost increase, thereby obtaining an aseismatically designed construction, which is anyway sized as a construction not subject to seismic events.

As it is known, in dry bridges having a continuous girder, the deck structure mass, which is relevant both as to size and as to position, makes the dry bridge sensitive and amenable to seismic events; this mass, in fact, generates the most significant inertial actions and causes the most significant displacements of the pier tops or, when the piers are very low, the stiff impacts that, combined with abrupt torsion effects due to asynchronous oscillations of the piers, almost always cause the support and junction equipment to go out of order and very often they cause the structures themselves to be damaged.

It is an object of this invention to totally neutralize any negative effects of this inertial mass so that the dry bridge is substantially separated from the seismic event, because all horizontal actions of seismic origin exerted on the piers, in most cases, are lower than the actions generated during usual operation of the constructions (wind, braking effects, centrifugal forces).

According to the invention, the dry bridge is separated from the seismic events generated by the deck structure mass, by clearing, on the horizontal plane, the deck structure from its piers by means of particular movable multidirectional abutment apparatuses, having almost null sliding resistance and by connecting the deck structure and its support by means of a particular swinging device that, while allowing relative displacements, enables a predetermined action of constant value to be exerted in opposite direction with respect to the displacements themselves, such that the deck structure-support assembly is restored to its original attitude when the event which caused such attitude changes ceases.

The suggestion according to the invention provides that a set of devices be inserted between the supporting structure and the supported structure, so as to substantially modify the oscillation characteristics of the pier-deck structure assembly by decoupling said parts and providing the deck structure with an independent oscillation period different from the oscillation period of the piers.

It is known that, in structure subjected to oscillatory motion, a dynamic amplification of the oscillations occurs when the frequency of the excitation force takes values near to the natural frequency of the swinging structure (resonance effects), while an opposite effect is obtained (the oscillation are damped) when the frequency of the excitation force is much higher than the frequency of the swinging structure.

The aseismatic system proposed according to this invention is based upon the above described principle because, when the deck structure is decoupled on the horizontal plane from the tops of its abutments and when they are re-coupled by means of a very low frequency oscillating system, namely a system having an oscillation period much higher than the one of the abutments, the deck structure is no more in a condition to oscillate simultaneously therewith, but, since it moves more slowly, it is no more responsive to rapid pulse it receives from below.

The aseismatic system according to this invention, therefore, substantially comprises a decoupling and abutment system and a return system.

The apparatuses for resting the deck structure upon the piers and upon the abutments should allow a complete freedom of relative displacements on the horizontal plane, with swings of even a noticeable amount in any direction, with a resistance of insignificant values to said displacements.

In this way, the piers and the abutments are cleared from the deck structure they support as well as with respect to one another, so that it is no more possible that inertial forces be transmitted between any involved parts.

In other words, the inertial forces of seismic origin acting upon the deck structure are noticeably reduced and the relevant stiffness of the deck structure on the horizontal plane is no more capable to cause equal horizontal displacements to piers of different stiffness, thereby eliminating also any dangerous concentration of horizontal forces on the shorter and stiffer piers.

Still according to the suggestion of this invention, the return system which the deck structure is provided with should be adapted to generate forces of calibrated and programmed amount when a relative movement occurs between the piers and the deck structure.

Such forces should be opposite to the movement direction and should be directed to the pier axis so as to be capable to return the pier and the deck structure in axial alignment when, due to any horizontal action (of seismic or operation origin) they are displaced therefrom; in addition, they should also be adapted to fulfil the requirements of a normal operation, namely they should be adapted to validly contrast the actions generated by wind, braking or by centrifugal forces and lastly they should allow the development of slow deformations due to temperature, shrinkage and viscosity.

Still according to this invention, said return system should have a natural oscillation period noticeably longer than the oscillation period of the piers or of the abutments, as provided according to the design structural provisions.

Such a requirement is essentially important in view of the fact that only when it is fulfilled the oscillation frequencies of the piers and of the abutments under the effects of a seismic event are not transmitted to the deck structure which remains effectively stationary, while the piers and the abutments can be freely oscillating in any direction, without interacting either with the deck structure or with the other piers or abutments of the dry bridge.

It is specific subject-matter of this invention an aseismatic system based upon the above set forth principles and substantially comprising abutment/decoupling means and return means in order to prevent relative displacements between pier and deck structure, wherein said means are mutually connected by means of ropes.

According to this invention, said abutment/decoupling means comprise superimposed plate means, respectively integral with the deck structure and with the piers, by which a first and a second superimposed and parallel recesses am formed, wherein a first and a second sets of orthogonally arranged running rollers am housed, in order to allow displacements between the deck structure and the piers in any desired direction.

Still according to this invention, said rope means connecting said abutment/decoupling means with said return means are extended through a suitable recess made in the upper plate of said abutment/decoupling means and are attached thereto by retain means. In addition, pin means are provided between the upper plate and the next lower plate, spaced from one another by said running roller means with transversal movement, in order to prevent said transversal displacements between deck structure and said piers during normal operation.

Furthermore, said running rollers provided in said second and third recesses are provided at their ends with pinions for running in correspondent racks provided on said plates.

The return system as provided for by this invention, in correspondence to any abutment devices comprises spring resilient means as well as contrast means of gravimetric type, wherein the lower end of said spring resilient means is connected to the pier body and wherein said upper end is connected, by rope means slidably arranged in pulley means, to said contrast means of gravimetric type, wherein said pulley is provided with bracket and thimble means for connection of second rope means that, after having been suitably relayed on second pulley means, are designed so as to be housed in said recesses provided in said abutment/decoupling means, so as to result into an oscillatory system with very low frequency, which, in addition to allowing relative displacements, is adapted to exert a predetermined action of constant value, directed to a direction opposite to the displacements themselves and such that the deck structure/abutment assembly is returned to its original attitude when the action by which such attitude was changed ceases.

This invention will now be described by way of illustration, not by way of limitation, according to its preferred embodiments, by referring to the annexed drawings, wherein:

FIG. 1 shows a schematic plan view of the return force system acting upon the continuous girder of an eight bay dry bridge between two thermal expansion joints, with applied bearing and return mechanisms, wherein a preferred arrangement of the return devices can be noted, said devices being arranged on the piers alternatively oriented in parallel and orthogonal direction with respect of the longitudinal axis of the deck structure;

FIG. 1*b* shows in plan view possible arrangements of the return systems for dry bridge sections with various numbers of bays;

Figure 3:
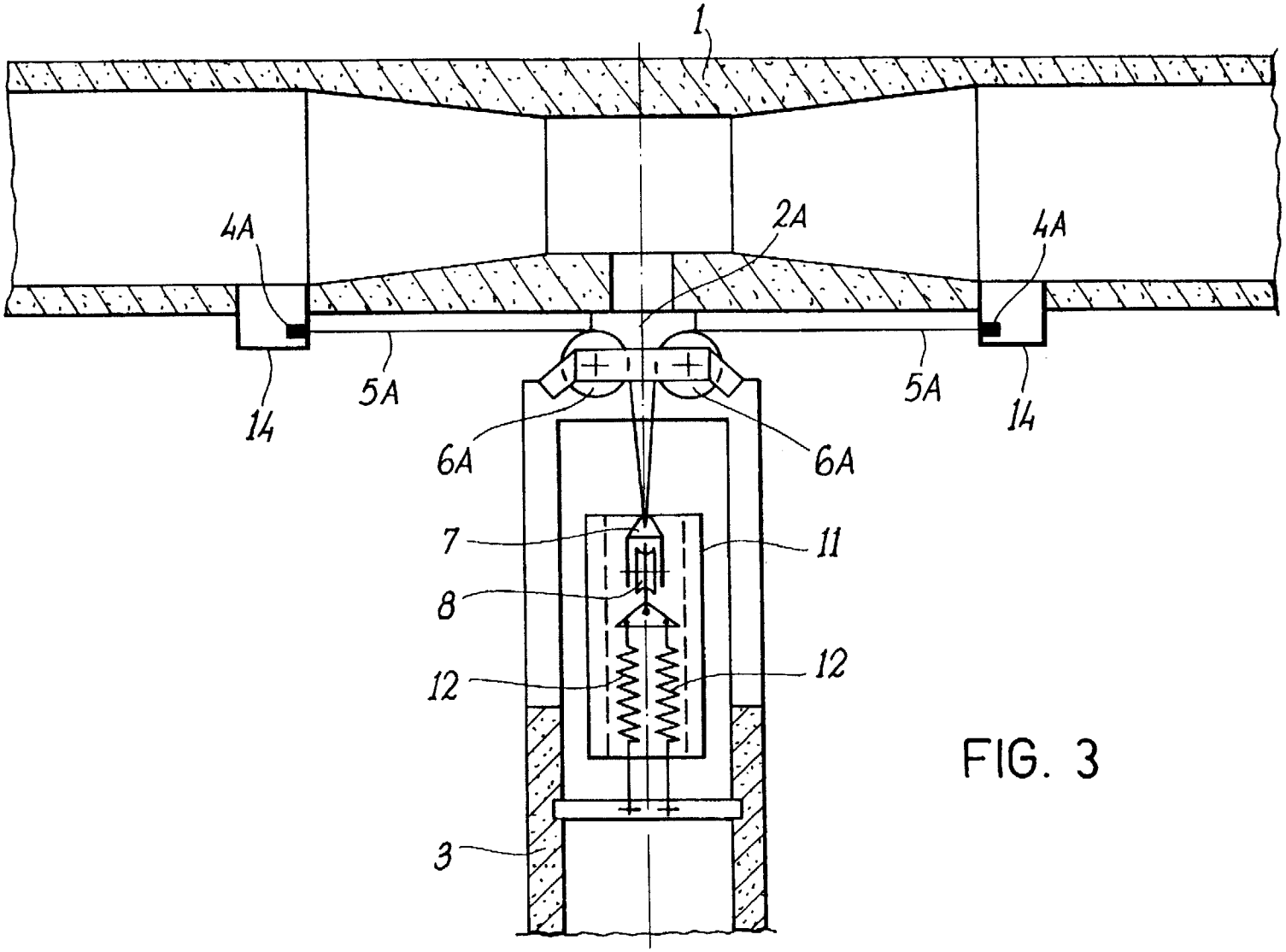
FIG. 3 shows the assembly of the return mechanisms of the aseismatic system according to this invention, when the force generated thereby is parallel to the longitudinal axis of the dry bridge.
Figure 3A:
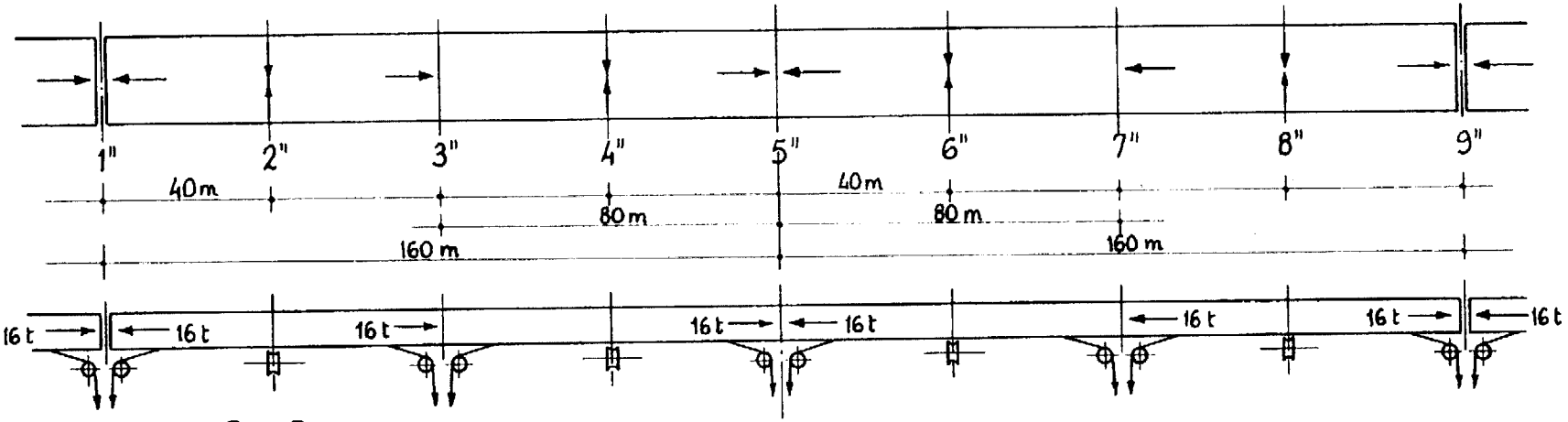
Figure 3B:
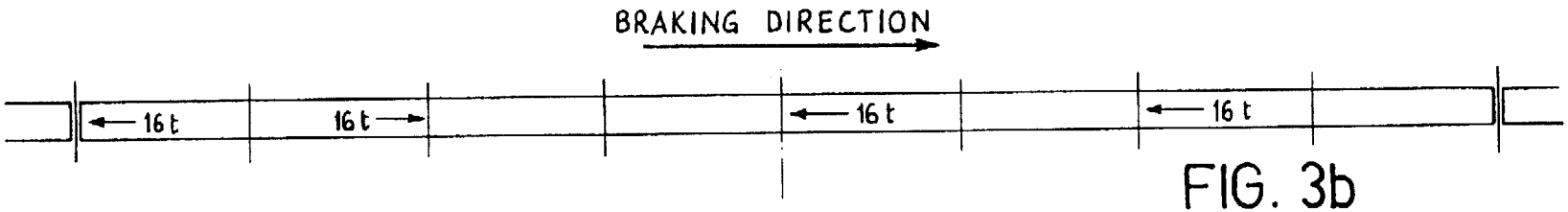
Figure 3C:
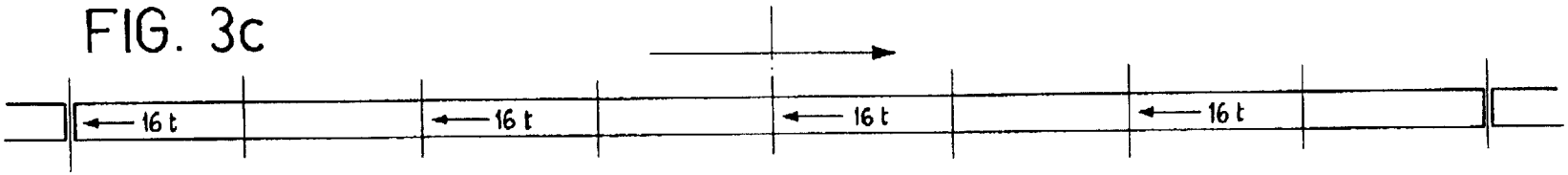
Figure 3D:
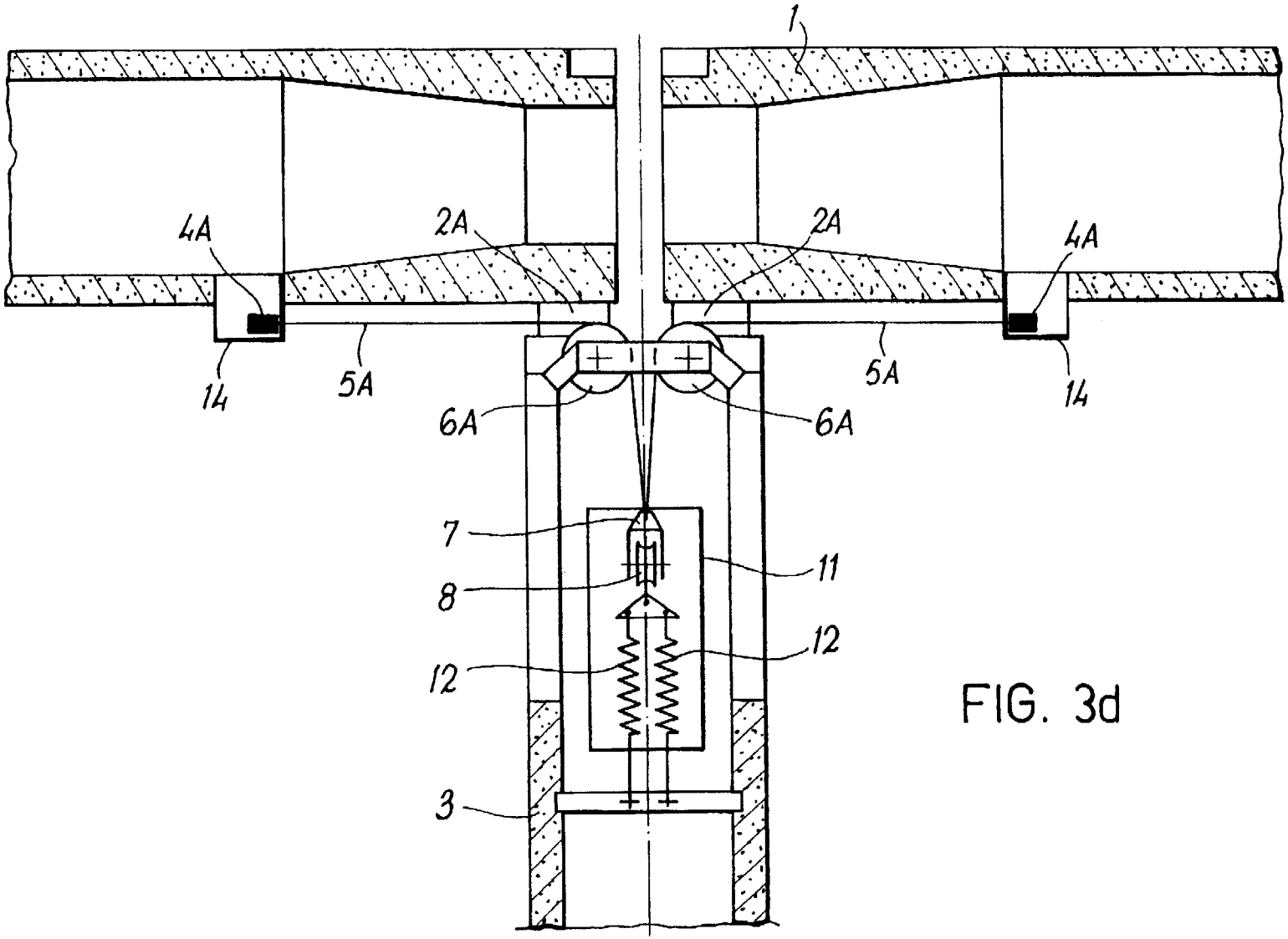

FIGS. 3*a*, 3*b*, 3*c* show a schematic view of the return force system when longitudinal forces are present as a result of braking actions;

FIG. 3*d* shows the assembly of the abutment and return mechanisms of the aseismatic system when a pier is present in correspondence to a thermal expansion joint.

Figure 5:
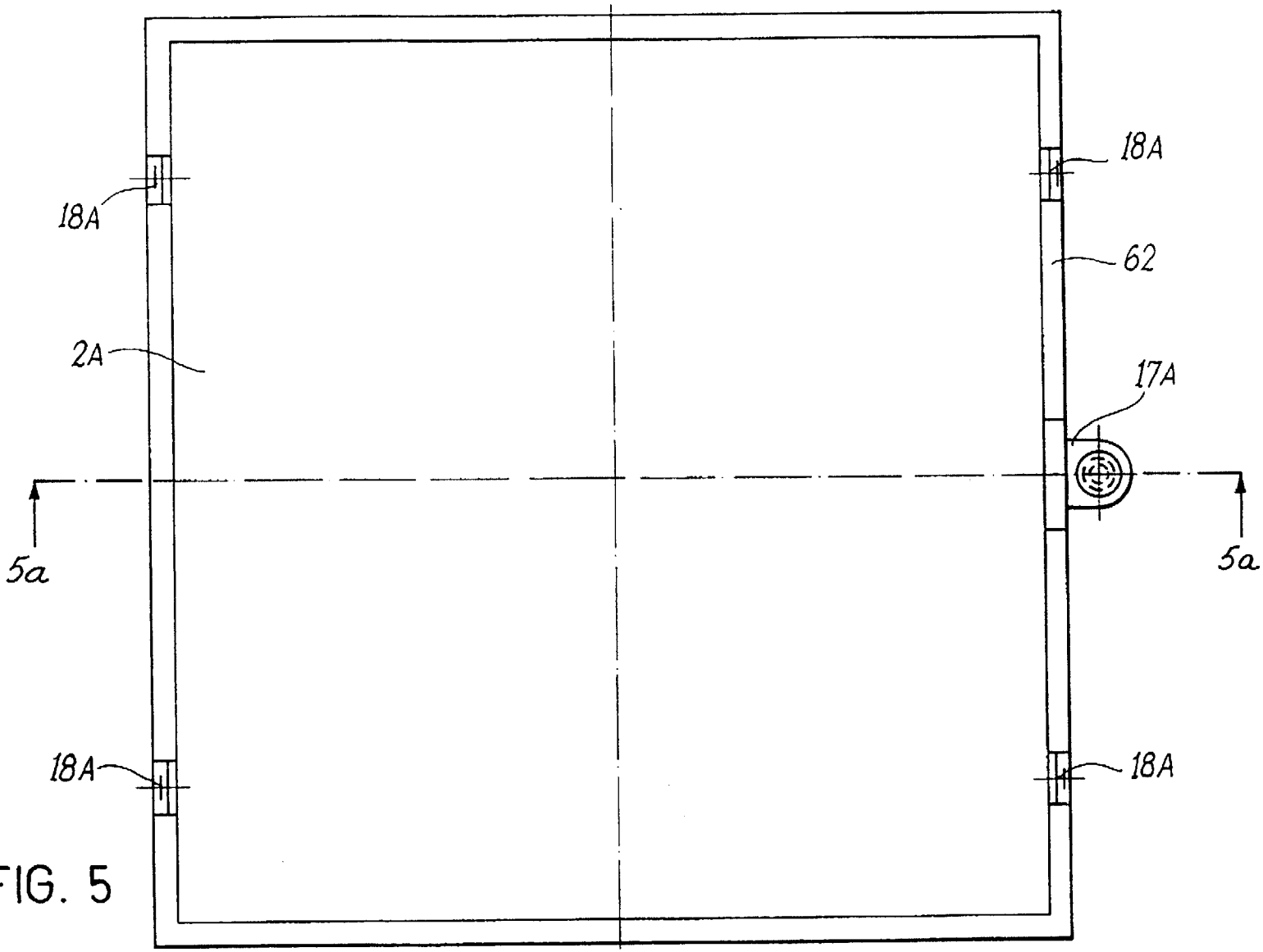
Figure 5A:
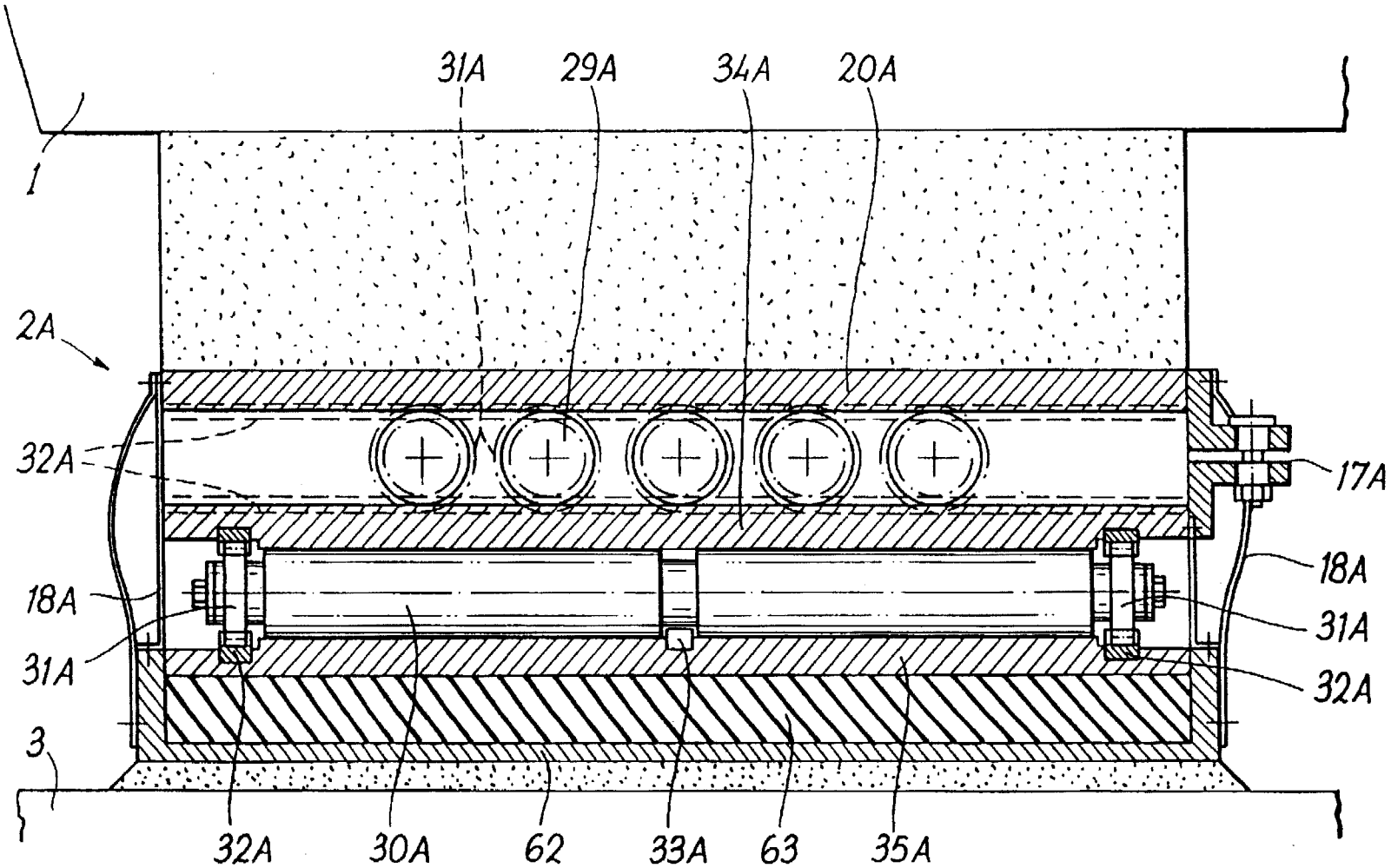
Figure 6:
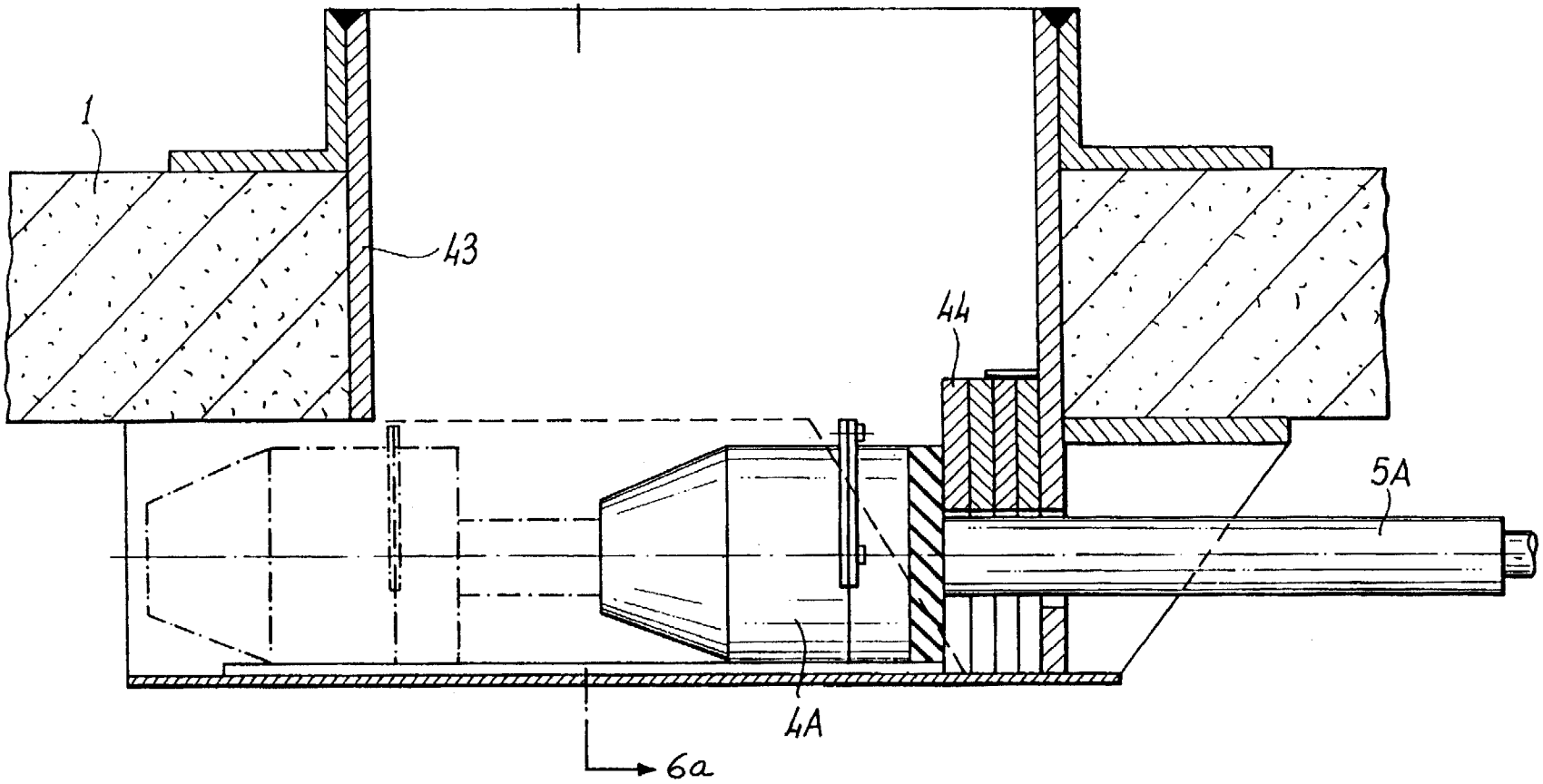
Figure 6A:
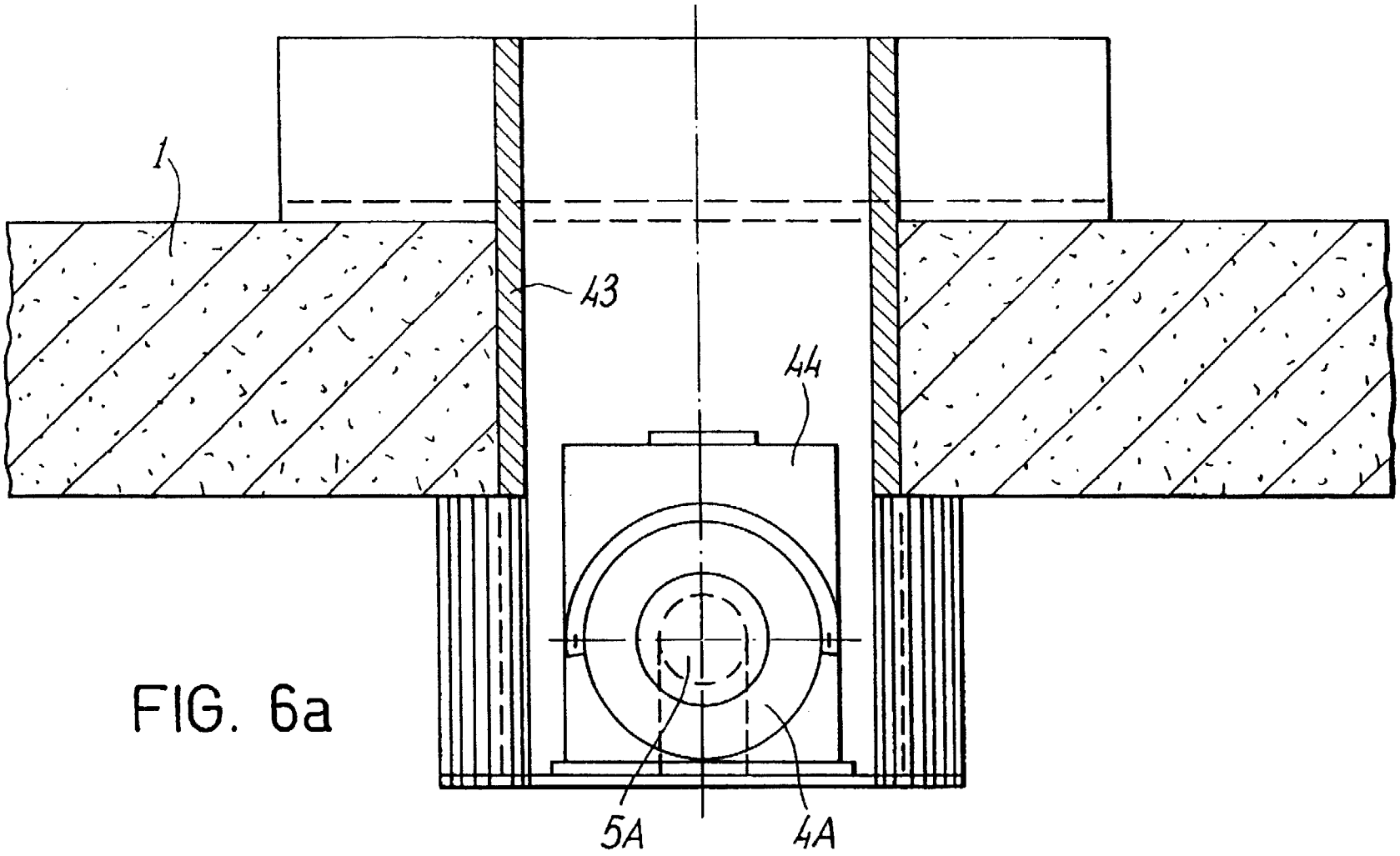
Figure 7:
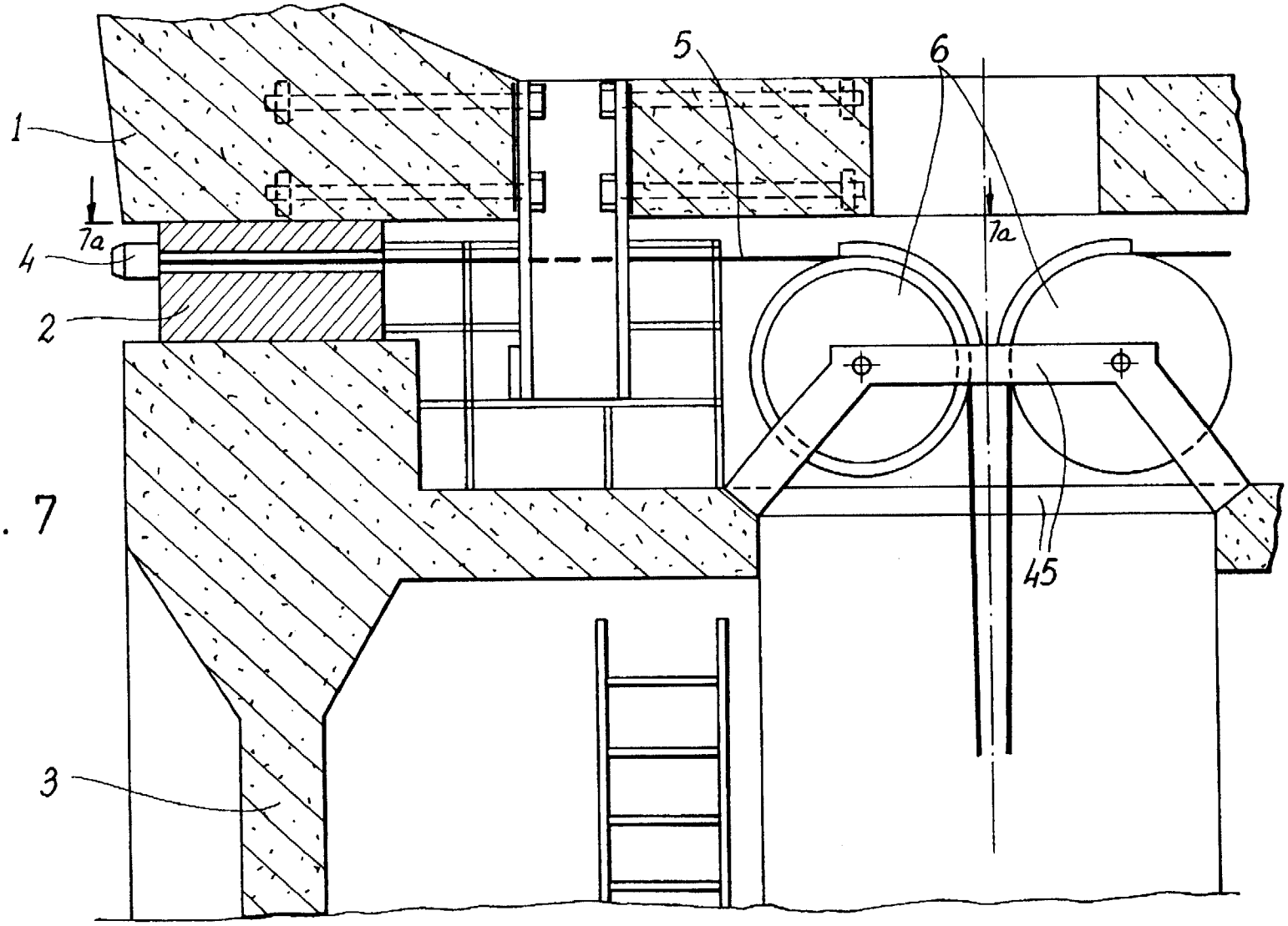
Figure 7A:
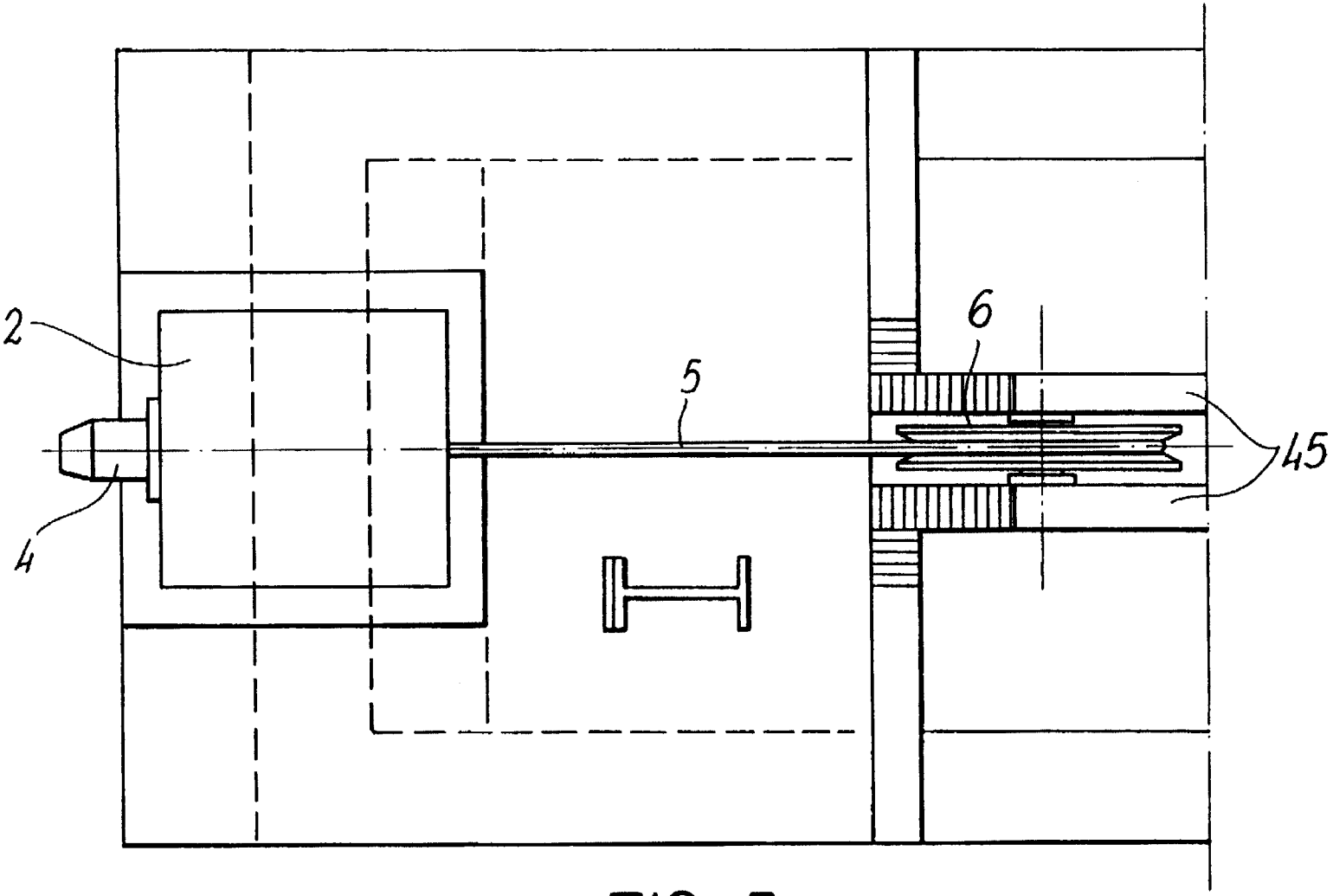
Figure 7B:
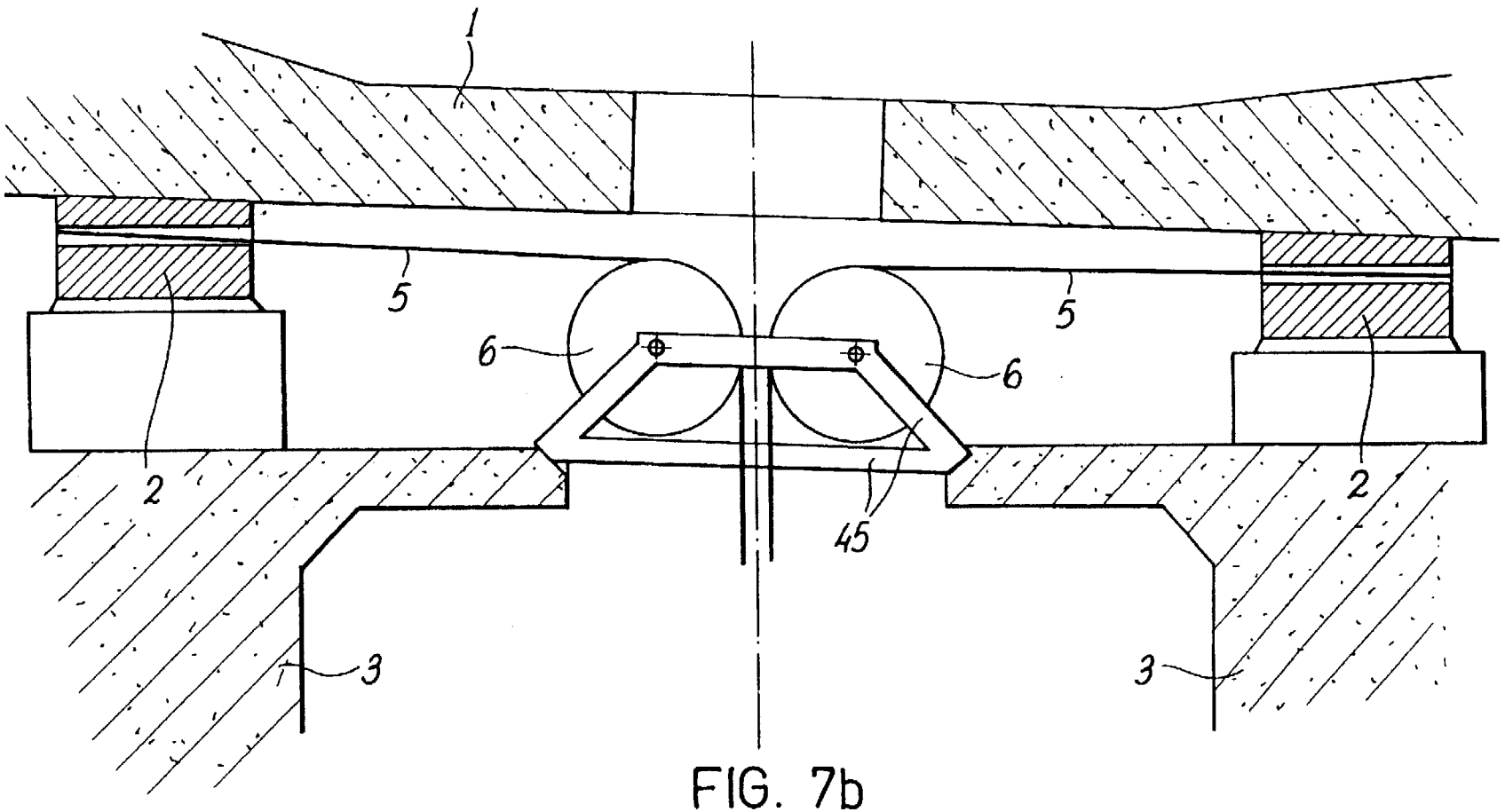
Figure 9:
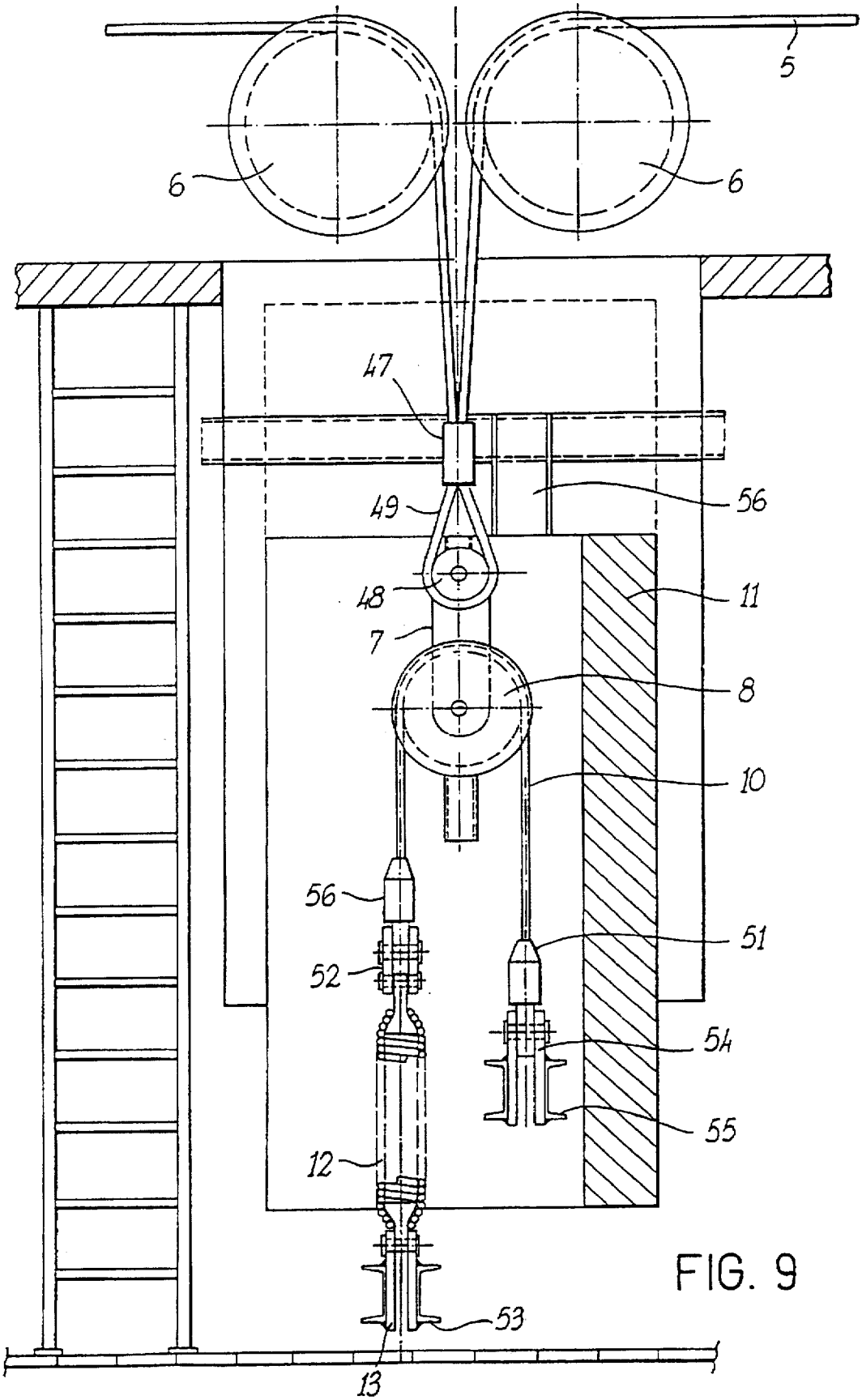
Figure 9A:
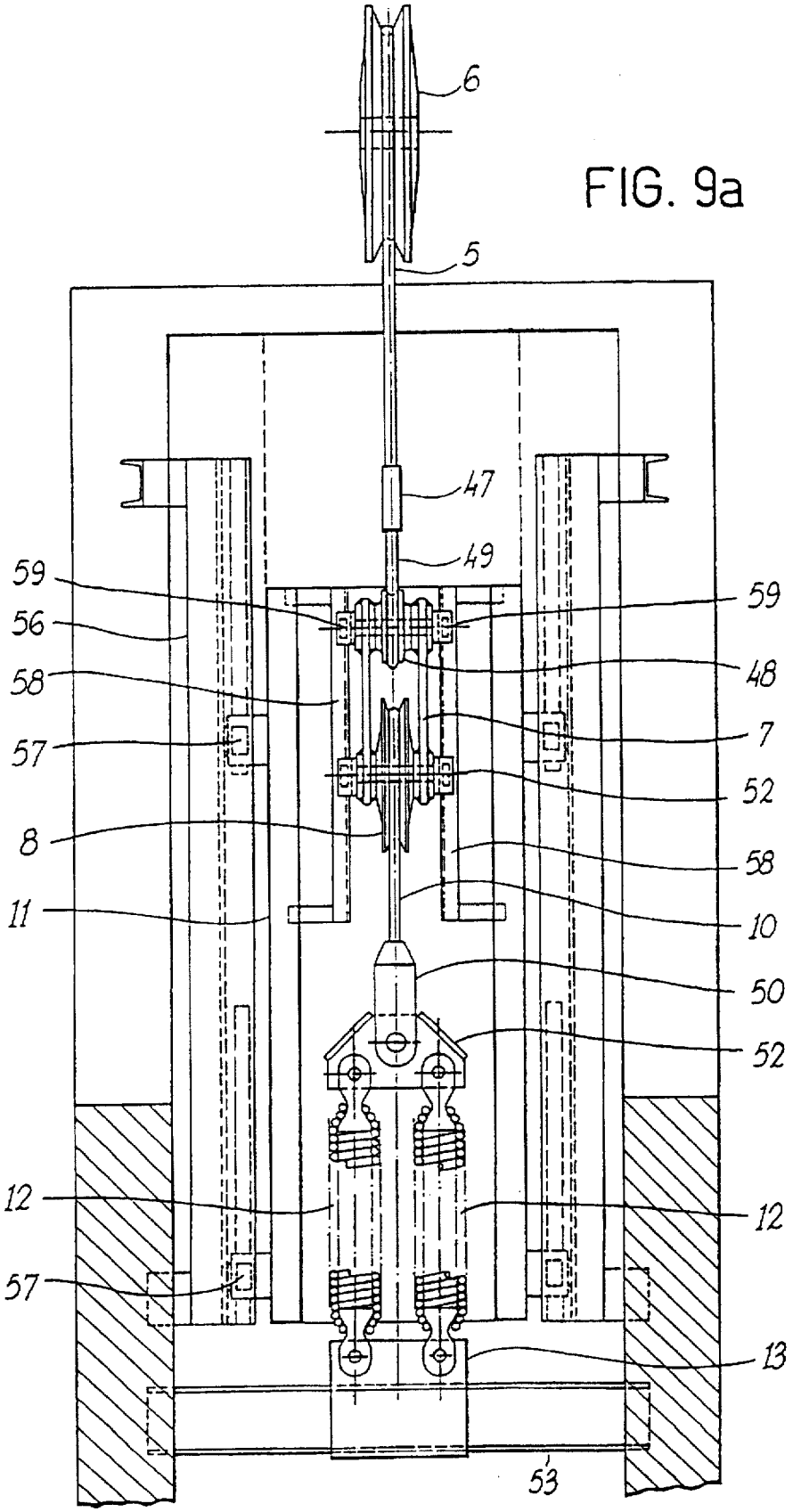
Figure 9B:
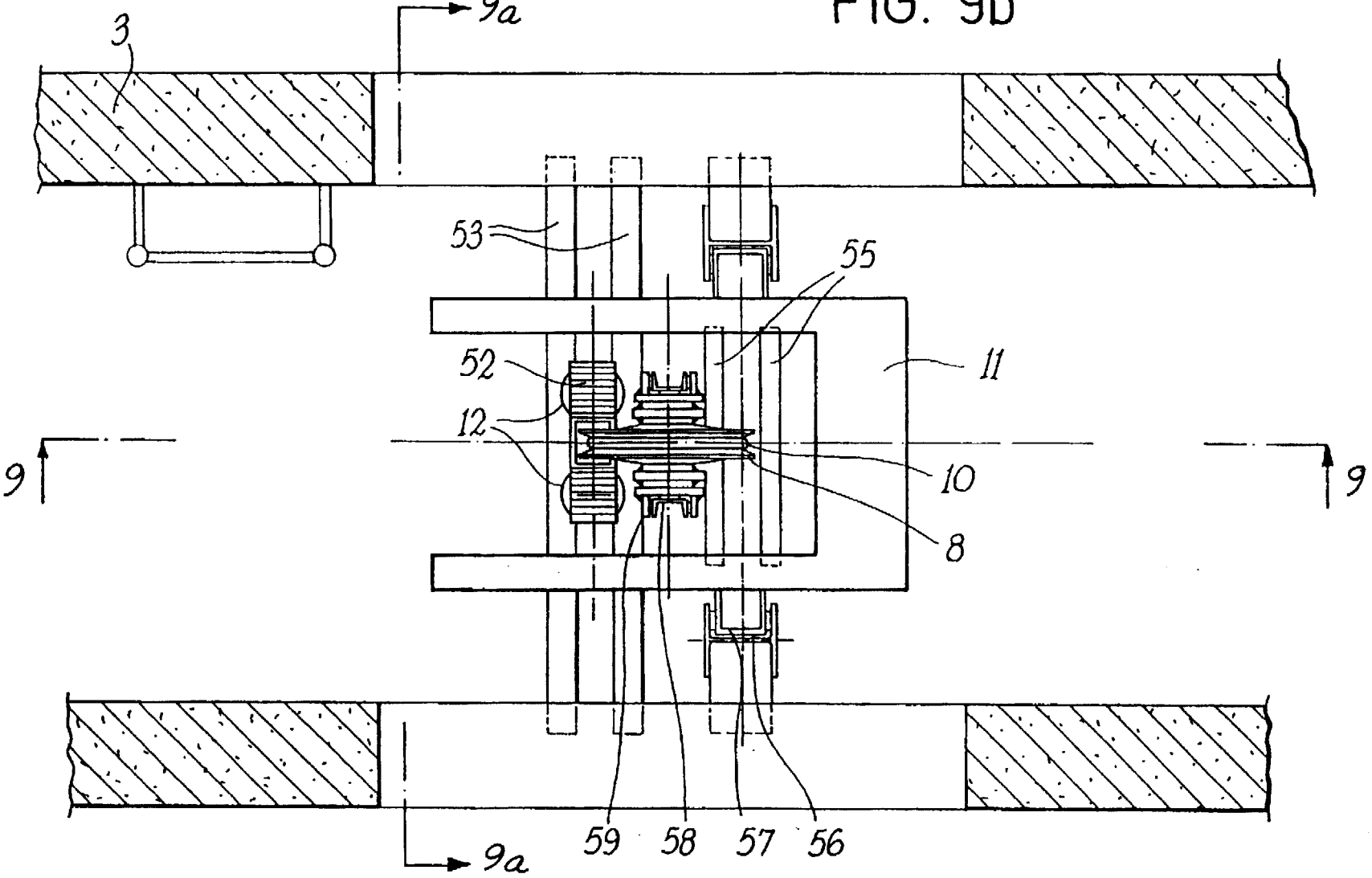
Figure 9C:
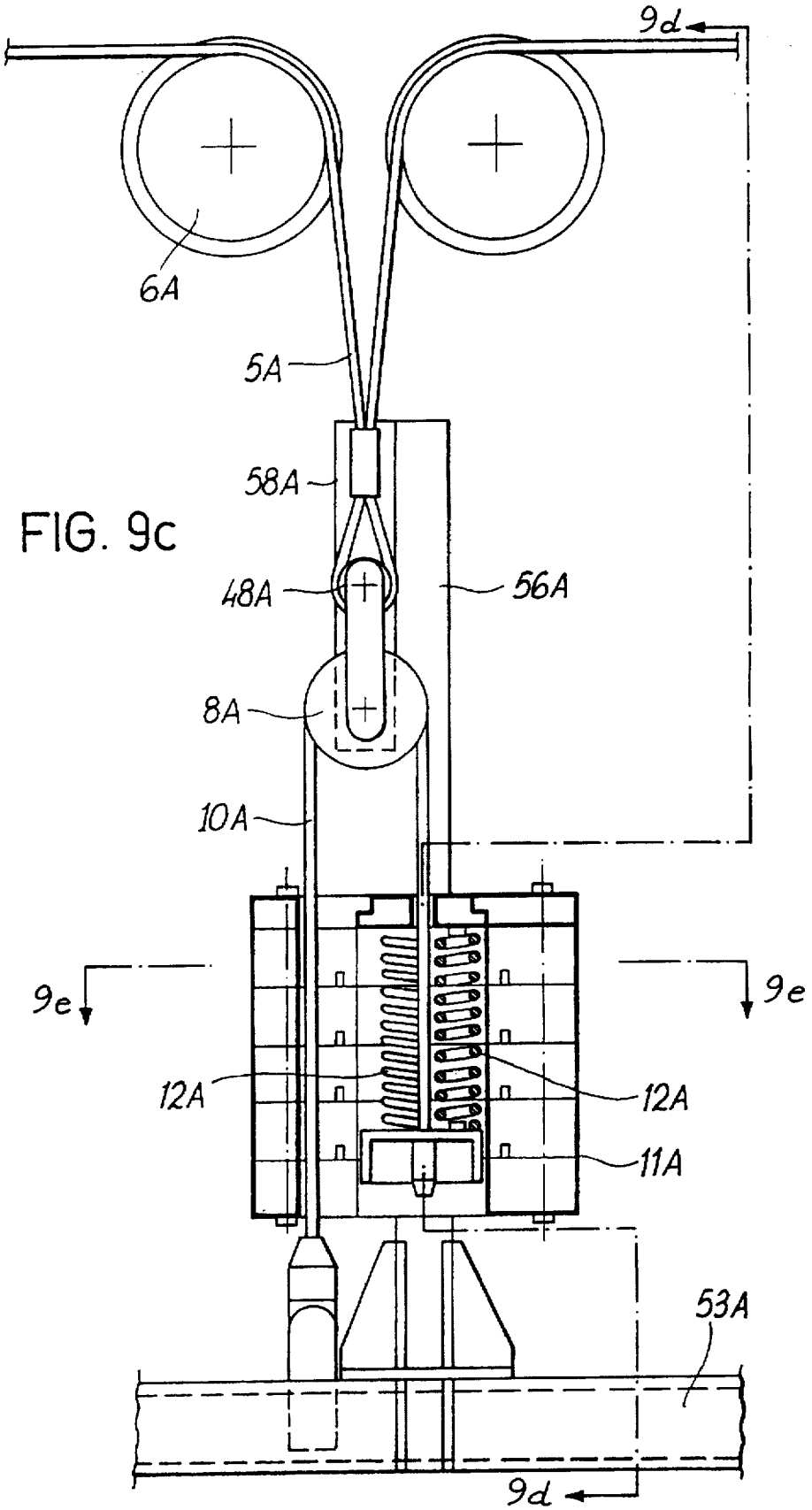
Figure 9D:
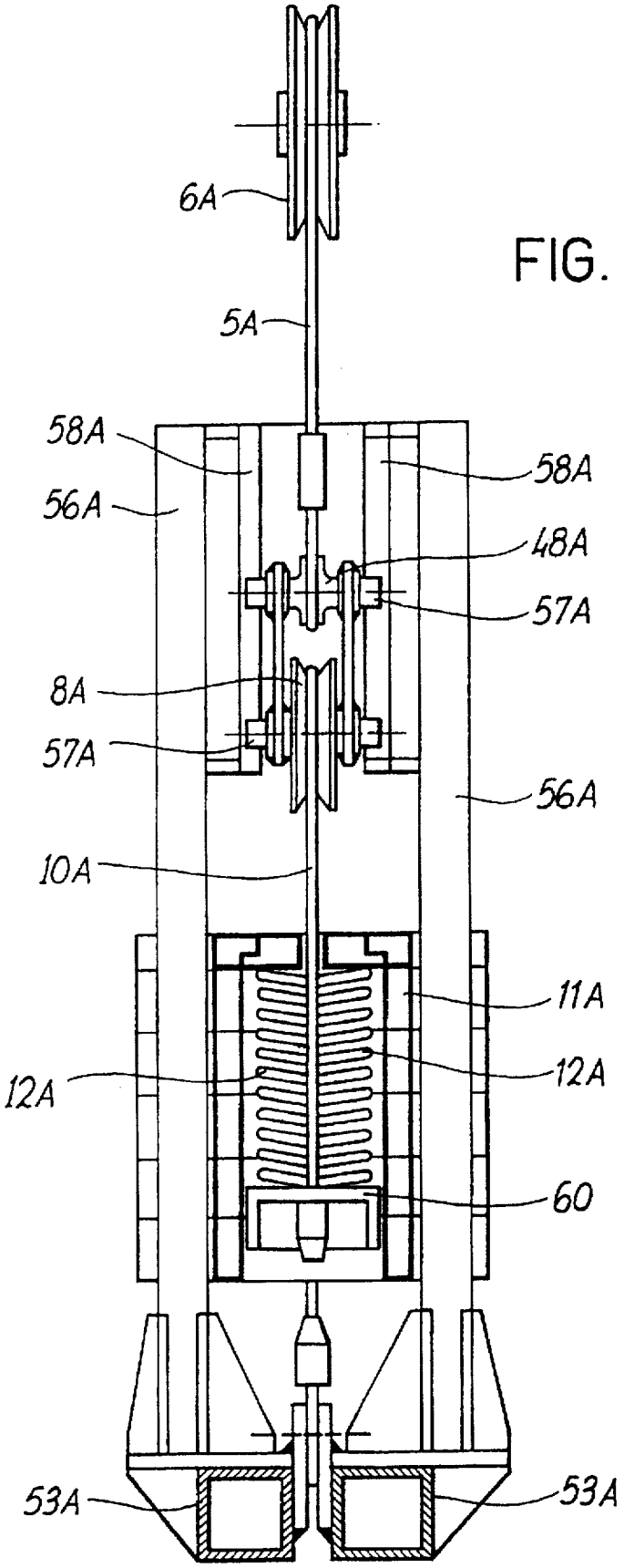
Figure 9E:
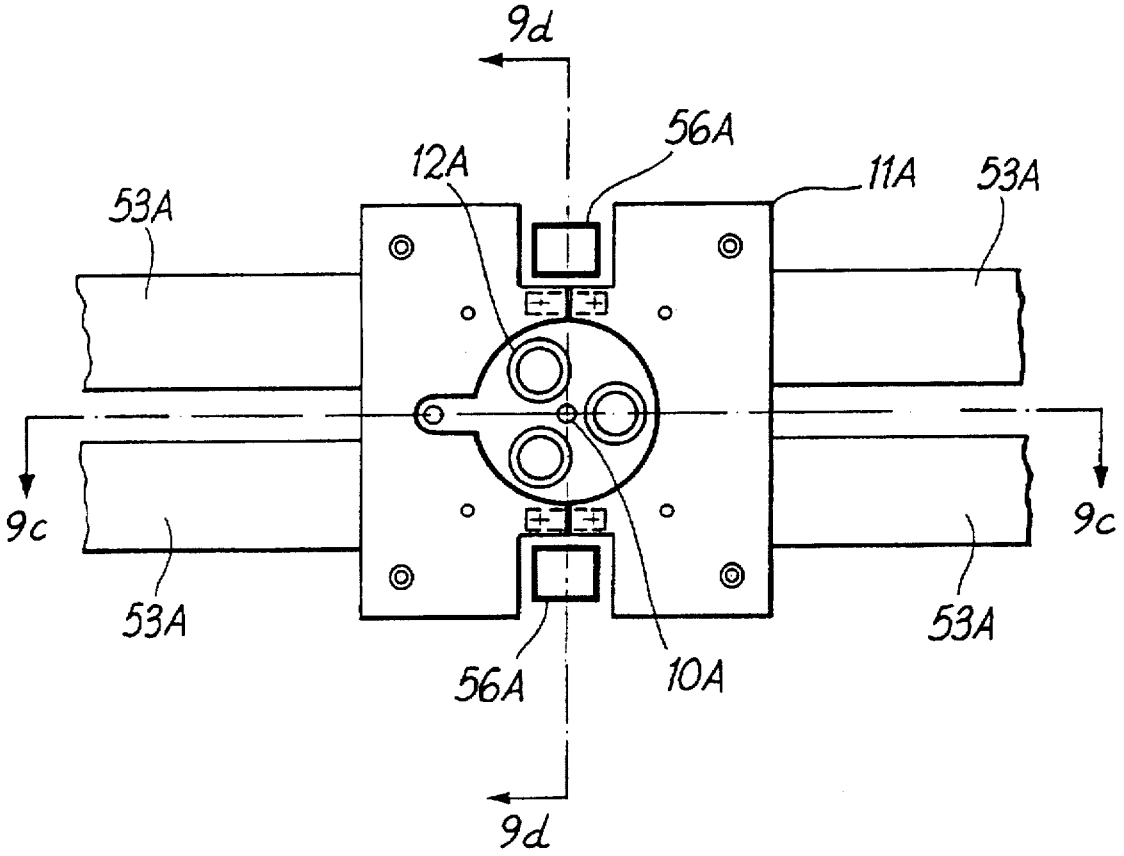
Figure 9F:
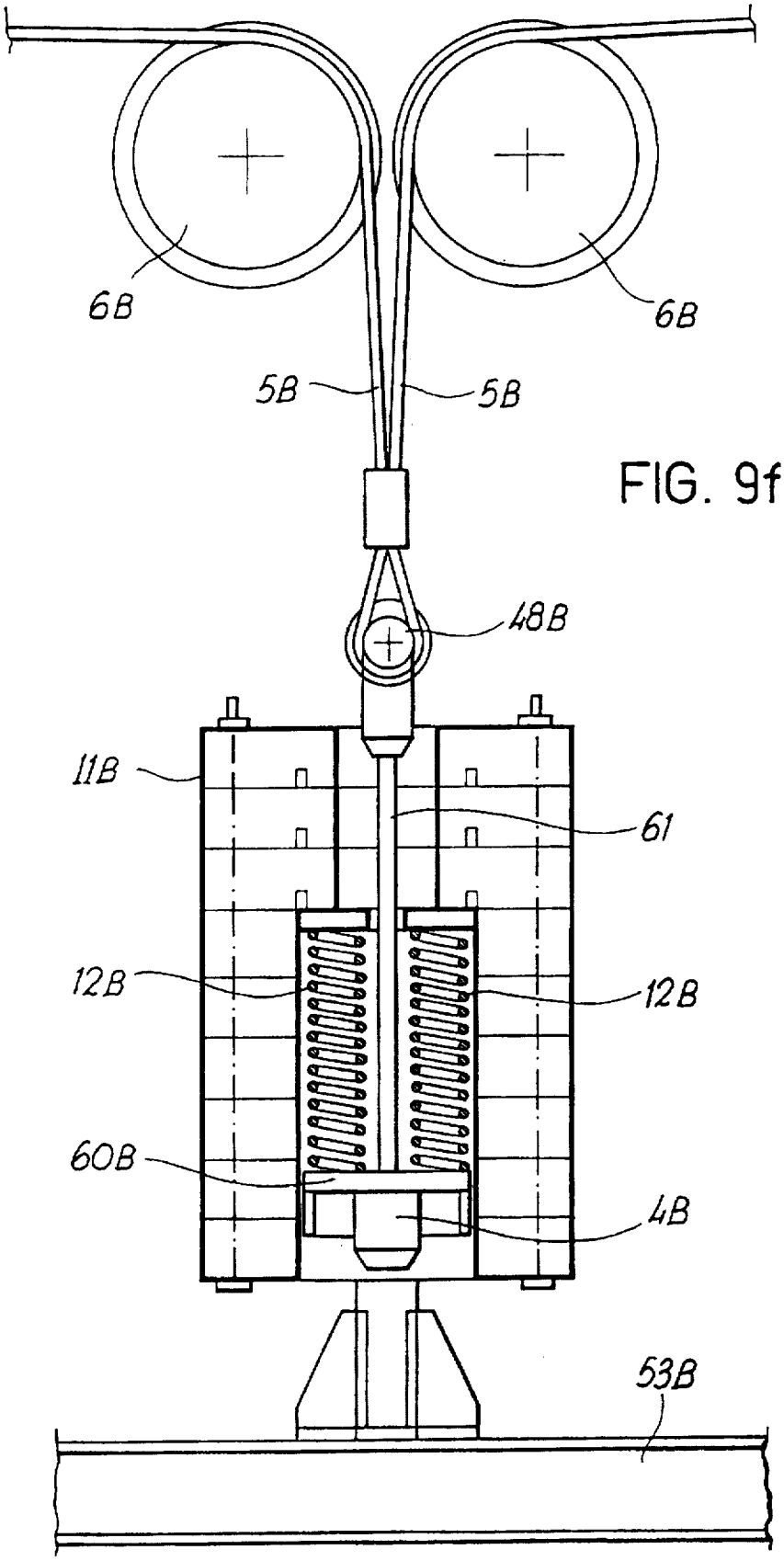
Figure 9G:
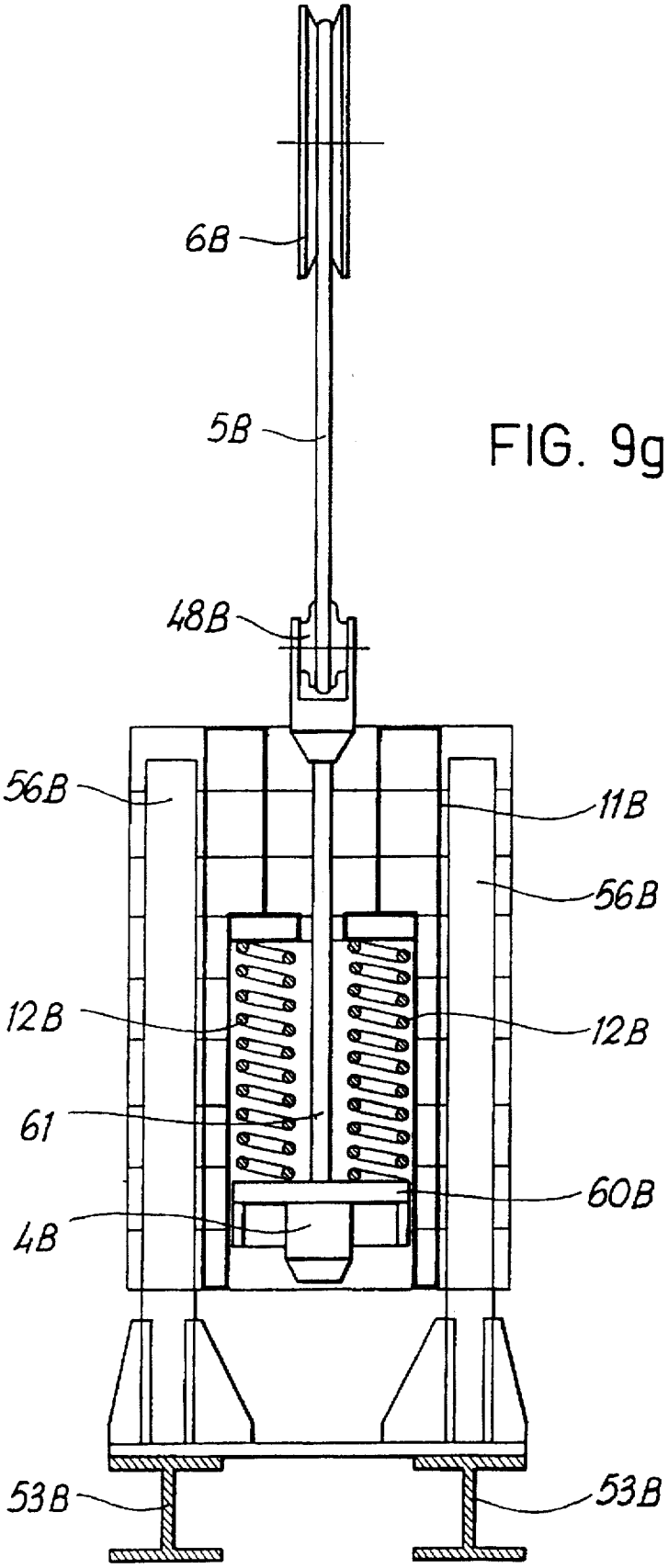
Figure 9H:
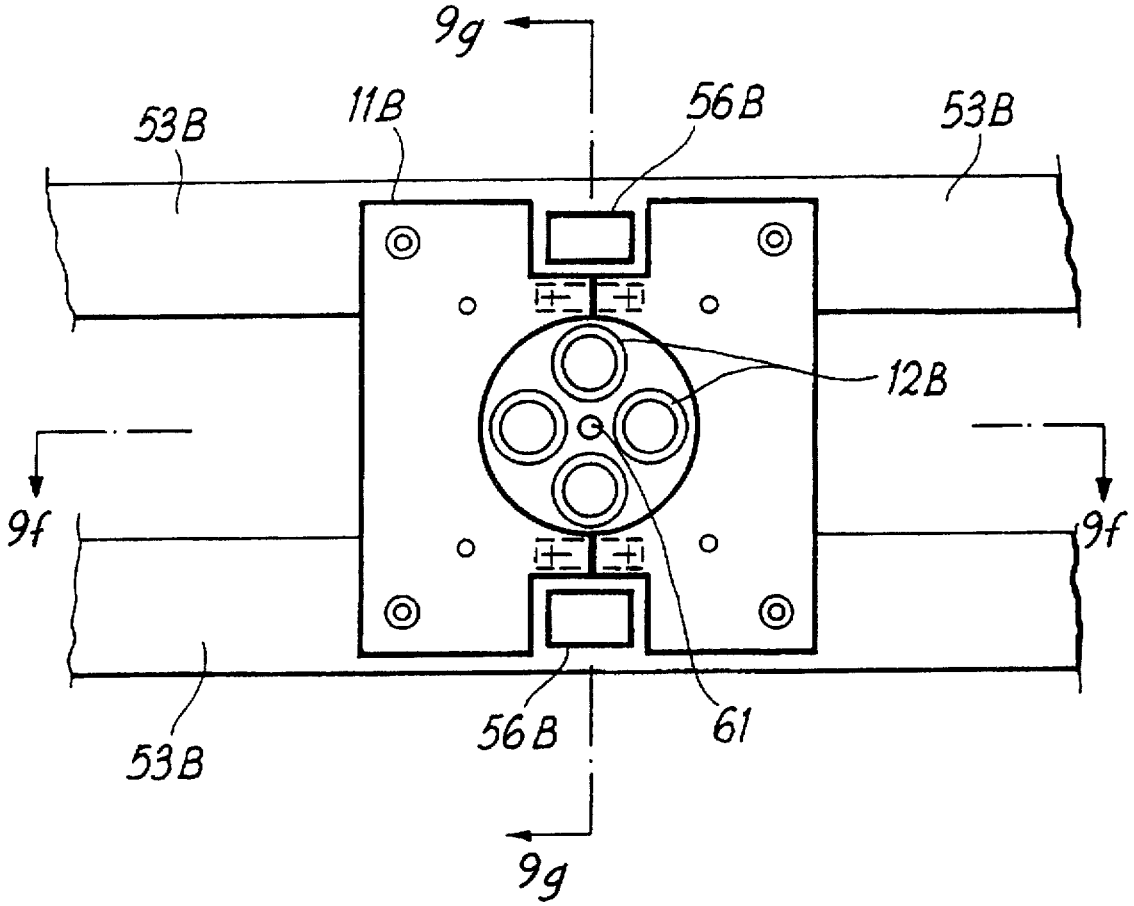
Figure 10:
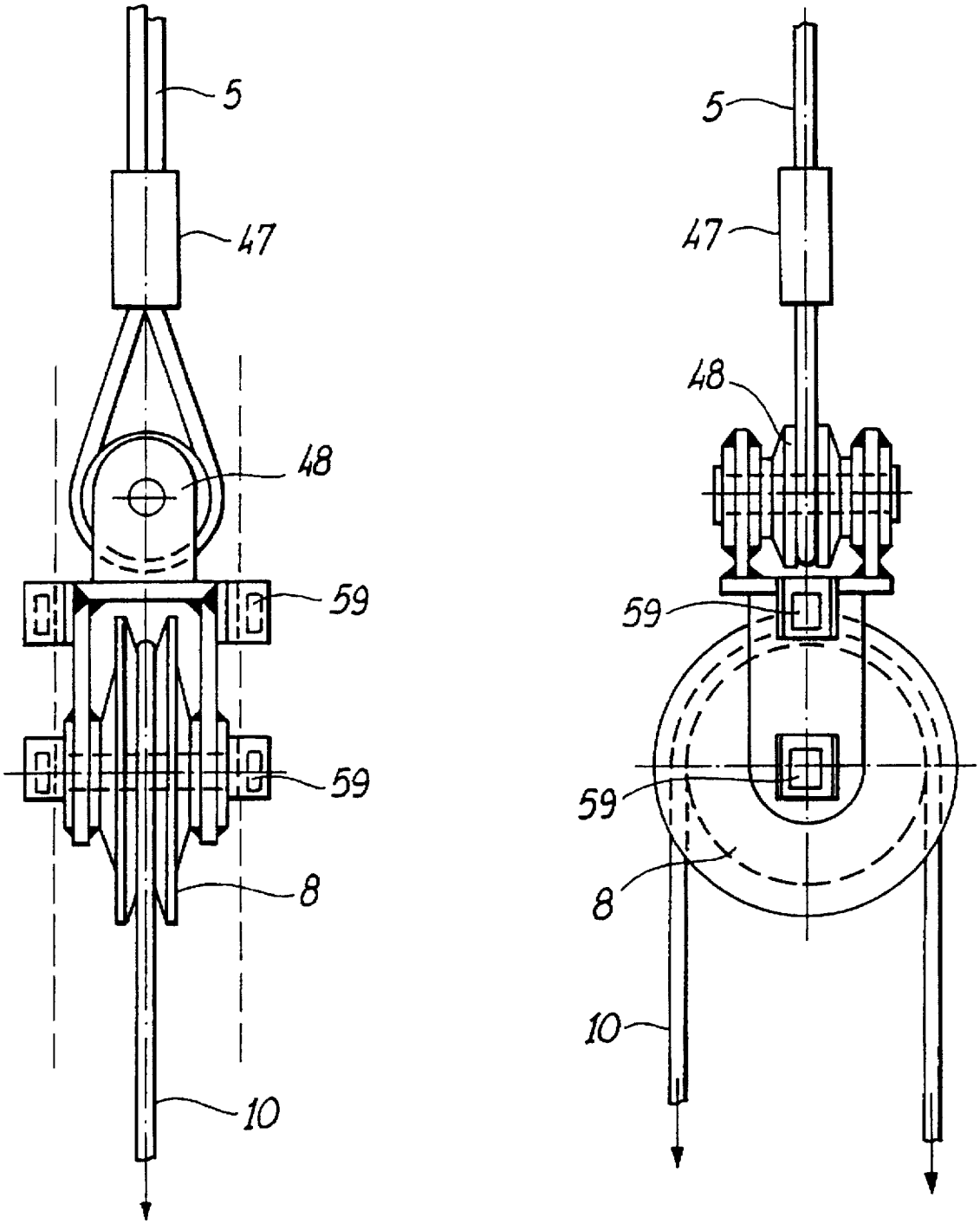
Figure 11:
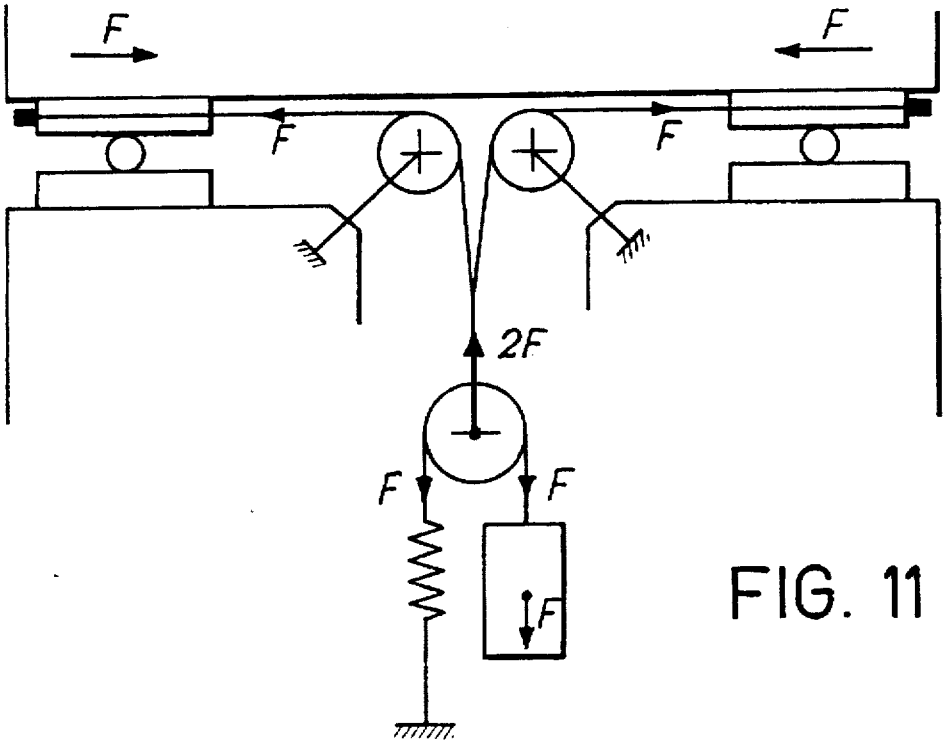
Figure 11A:
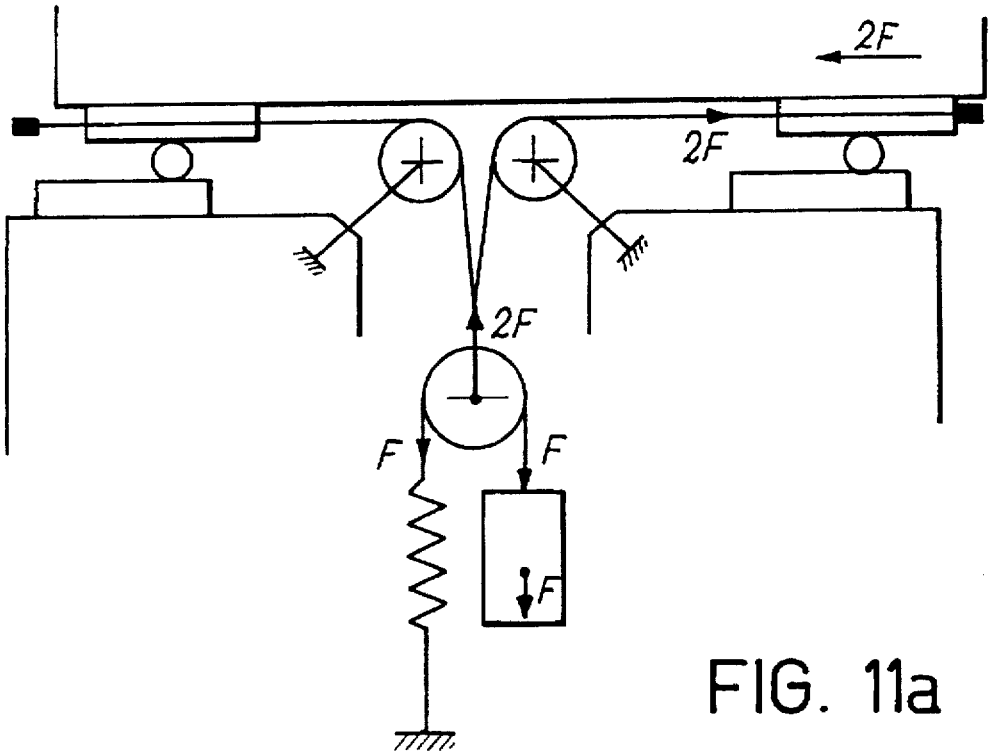

FIGS. 4, 4*a*, 4*b*, 4*c*, 4*d*, 4*e* show in plan, cross-section and detail the assembly of the support mechanisms of the aseismatic system according to this invention, when the return system acts in a direction orthogonal to the dry bridge axis;

FIGS. 5 and 5a show in plan and cross-section views the assembly of the support mechanisms of the aseismatic system according to this invention, when return forces act in a direction parallel to the longitudinal axis of the dry bridge;

FIGS. 6 and 6a schematically show in elevation cross-section views the system by which the return rope is attached to the intrados (i.e., the underside) of the deck structure when the return forces act in a direction longitudinal with respect to the dry bridge axis;

FIGS. 7 and 7a and 8 and 8a show in plan and cross-section views the relay pulleys of the return ropes and their supports placed at the tops of the piers when the return forces are orthogonal and parallel, respectively, to the longitudinal axis of the bridge;

FIG. 7b is a schematic view of the system in the case of a dry bridge with curved outline, namely when the deck structure is transversally slanted;

FIGS. 9, 9a and 9b show plan and cross-section views of the metal counterweight block, the anchorage system with two ropes coming from above, the anchorage to the counterweight block, the anchorage to the pier body;

FIGS. 9c, 9d, 9e show plan and cross-section views of a second embodiment of the counterweight block and of its anchorage members;

FIGS. 9f, 9g, 9h show plan and cross-section views a third embodiment of the counterweight block and of its anchorage members;

FIG. 10 shows a portion of the return device block shown in FIGS. 8, 8a, 8b, 8c, when the return forces act in a direction parallel to the longitudinal axis of the dry bridge;

FIGS. 11, 11a show a simplified operation diagram of the return system;

FIGS. 12, 12a 12b, 12c show plan and cross-section views of a preferred arrangement of the aseismatic apparatuses according to this invention in connection with a building.

The aseismatic system according to this invention can be applied to dry bridges, buildings, tanks and broadly to any structure characterized in that they have a heavy load resting on the top of a column member and substantially comprising mechanisms of two kinds: support or abutment mechanisms and return mechanisms.

The support or abutment mechanisms are so made as to allow a complete relative displacement freedom of the deck horizontal structure on the horizontal plane, even with strokes of noticeable amount, under development of insignificant resistance values to such displacements. Their embodiments are equal with exclusion of the upper plate in view of the possible presence of the return rope anchorage member, depending on whether they relate to abutments designed for piers with a return force acting in a direction orthogonal to the longitudinal axis of the dry bridge or to piers with a return force acting in a direction parallel to said axis.

Similarly, the return system should be adapted to generate forces of calibrated and pre-programmed values, acting in direction opposite to the displacements and directed to the pier axis.

Figure 1:
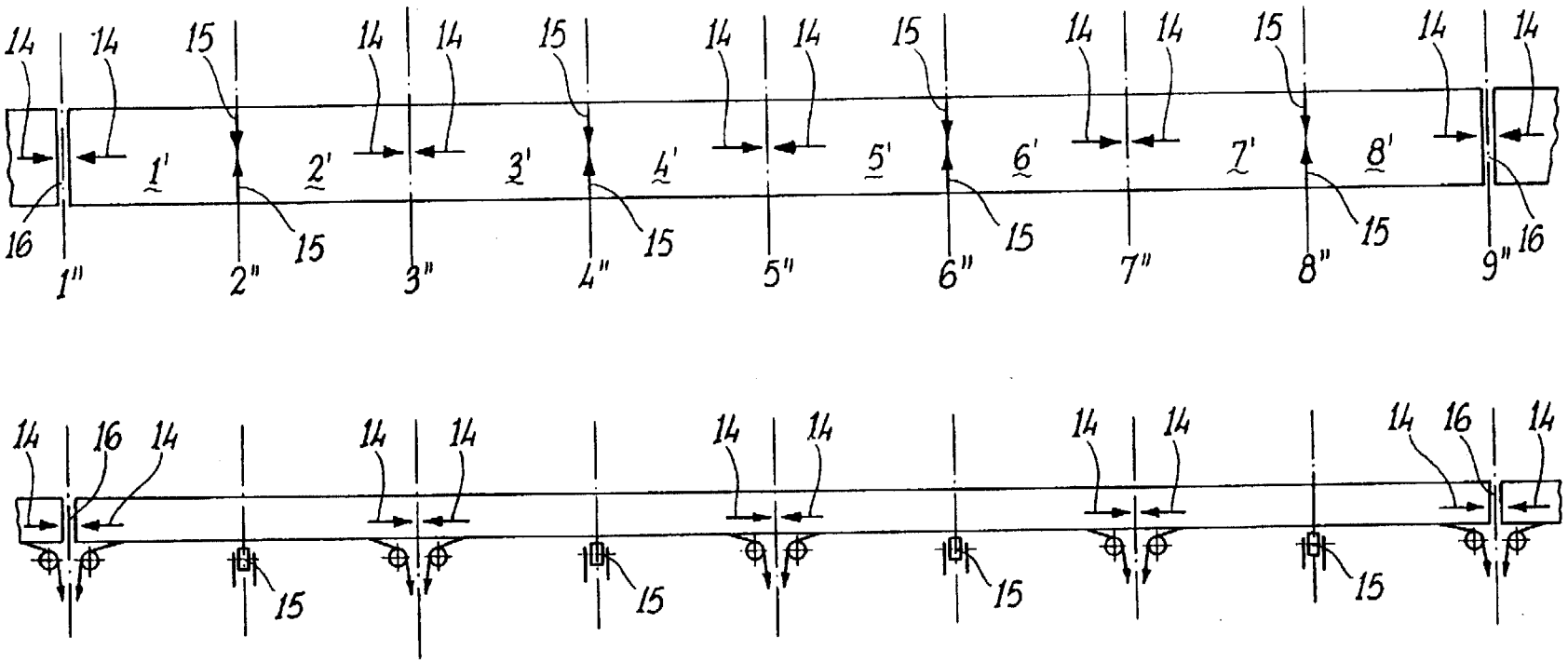

Based on these concepts, in order to better illustrate the force patterns, reference is now made to FIG. 1 which shows a schematic view, in plan and side elevation, of forces 14 and 15 generated by the return system upon a continuous length of a dry bridge consisting of eight bays, designated 1' to 8', resting upon nine piers, designated 1" to 9", by means of expansion joints 16, when the bridge is not subject to external horizontal forces. In this situation, the forces generated by said return mechanisms designated by arrows 14 and 15 are balanced.

The return system provided according to this invention reads to the displacements caused both in a direction parallel to and in a direction orthogonal to the longitudinal axis of the dry bridge by means of return forces acting in a direction parallel and orthogonal, respectively to said longitudinal axis.

A schematic view of the force patterns 14 and 15 is shown in FIGS. 3a, 3b and 3c which evidence the transformation of the previously balanced return force system in the presence of longitudinal forces due to braking.

By referring to FIG. 1, it can be noted that, according to a preferred embodiment, the return systems are alternatively arranged on the various piers, namely they are longitudinally arranged on piers 1", 3", 5", 7" and 9", and they are transversally arranged on piers 2", 4", 6" and 8". This arrangement simplifies the various mechanisms and their operation with respect to an equally valuable arrangement, according to which both return systems, the longitudinal and the transversal ones, are combined on each pier.

Figure 1B:
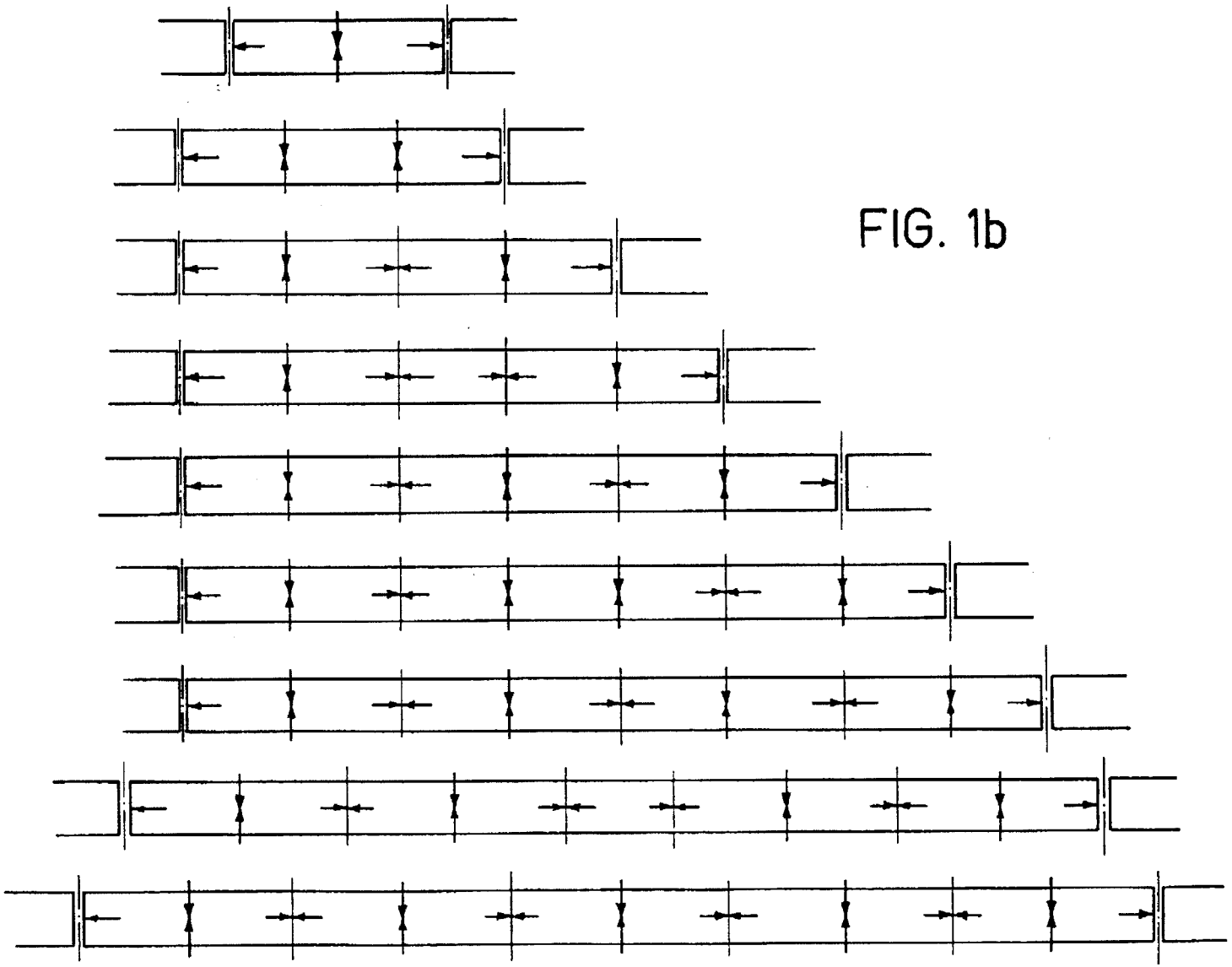

By referring to FIG. 1b, various preferred arrangements are to be noted, wherein the return devices are alternatively arranged on the piers in respect of dry bridge lengths comprising a different number of bays.

Figure 2:
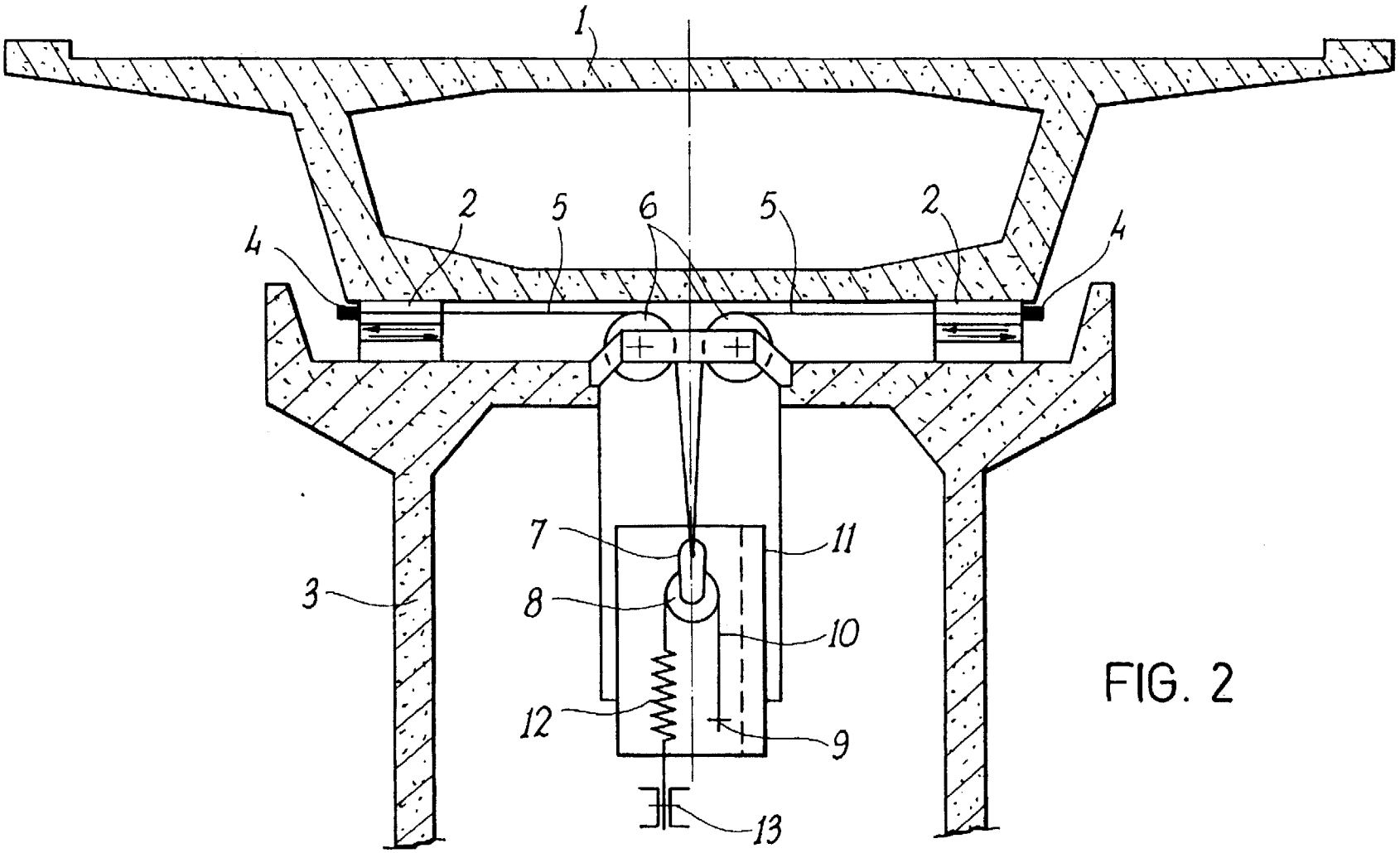
FIG. 2 shows the assembly of abutment and return mechanisms of the aseismatic system according to this invention, when the return mechanism directs its action orthogonally to the longitudinal axis of the dry bridge.

By referring to FIG. 2, it can be observed that, in correspondence to piers 2", 4", 6" and 8", the deck structure rests upon two multi-directional abutments 2, as schematically shown, arranged upon the pier dosseret.

By referring again to FIG. 2, it can be observed that the return system according to this invention substantially includes a counterweight 11, a resilient spring system 12, the ends of which are connected to the pier and to said counterweight, respectively, a pulley transmission and relay system 6 and the return ropes 5, the head of which is in contrast to said multi-directional abutments 2.

As it will be more detailedly illustrated hereinbelow, said heads 4 of the return ropes 5 are in contrast to the portion of the abutment integral to the intrados of the bridge deck structure 1.

In the case of forces acting in a direction parallel to the longitudinal axis of the deck structure and, therefore, in correspondence to piers 1", 3", 5", 7", 9", the arrangement of the support and return mechanisms is as shown in FIG. 3, wherein it can be observed that the heads 4A of return ropes 5A, directed to said pulleys 6A, are anchored to the intrados of the deck structure 1 by means of a metal box 14 and that the return system similarly maintains the same orientation within the pier.

Figure 4:
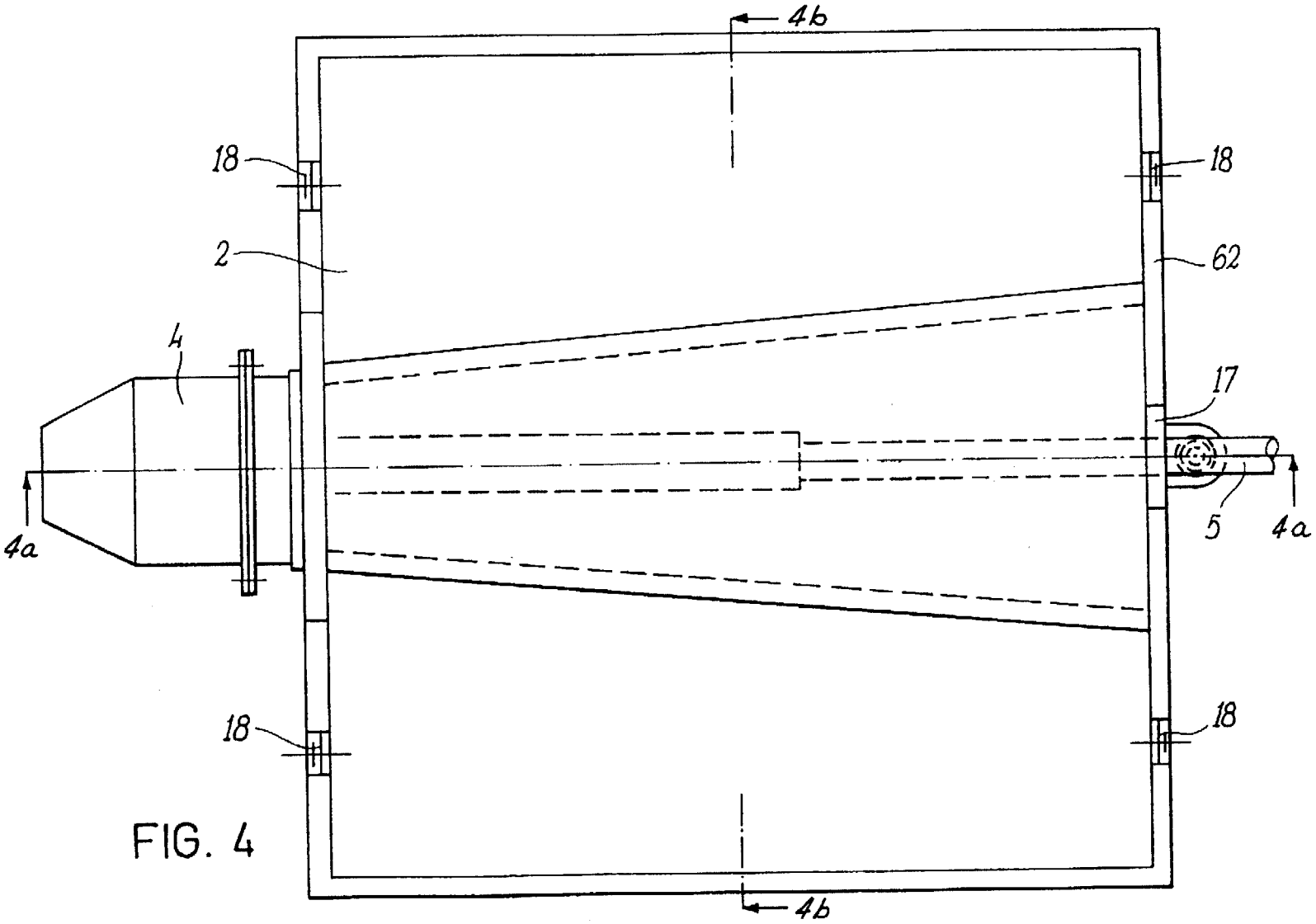

For an arrangement wherein the return force is orthogonal to the longitudinal axis of the dry bridge, the above said multi-directional abutments are schematically shown from above in FIG. 4, wherein it is possible to note the head 4 of return rope 5, the contrast pin 17 for resisting the wind action and the provisional blocking and assembling plates 18 for the transport and erection steps.

This kind of support is essentially formed by two portions, an upper portion to attach the return rope 5 to the bridge deck structure 1 and a lower portion which allows the pier 3 to carry out any movement in horizontal plane with respect to the deck structure.

Figure 4A:
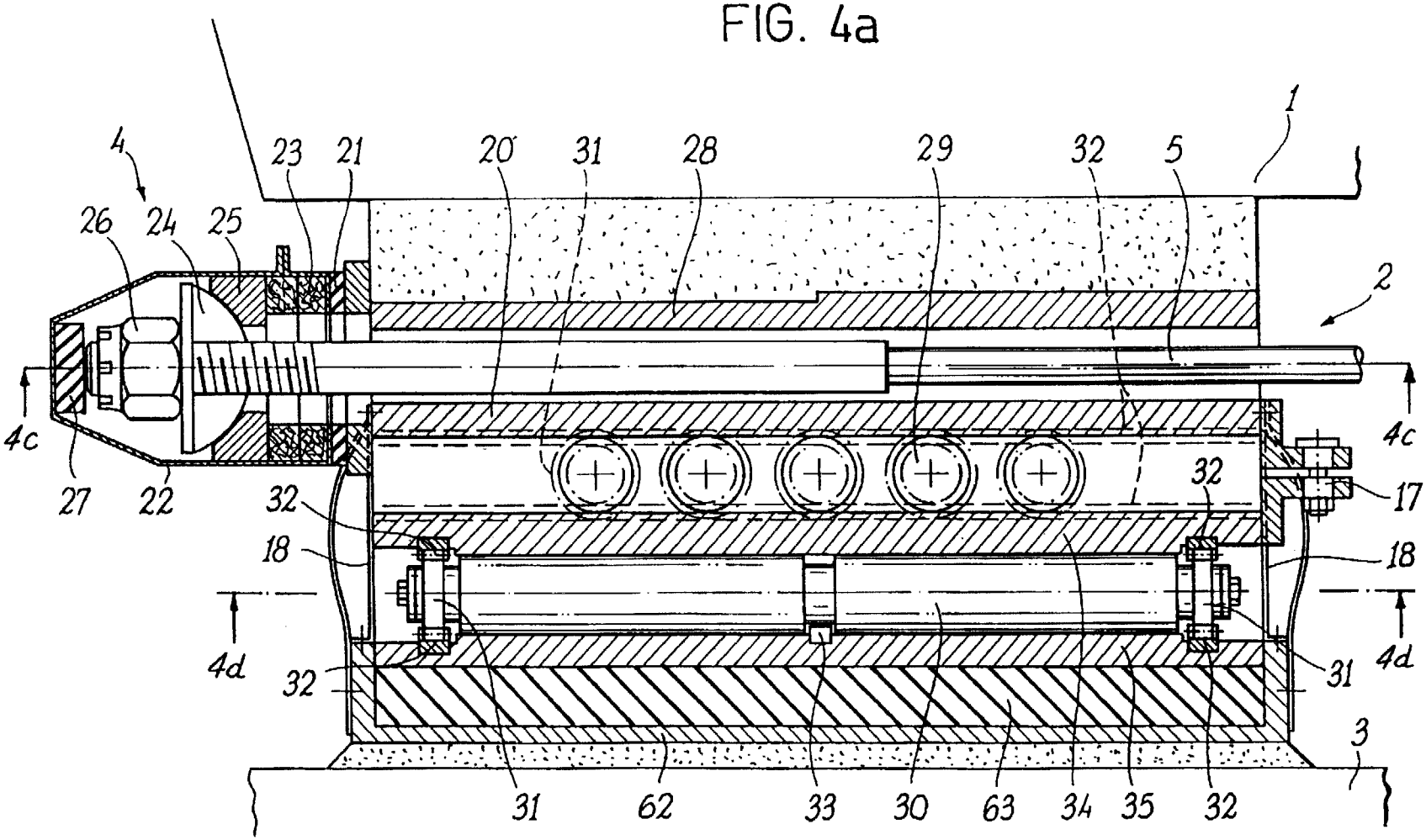
Figure 4B:
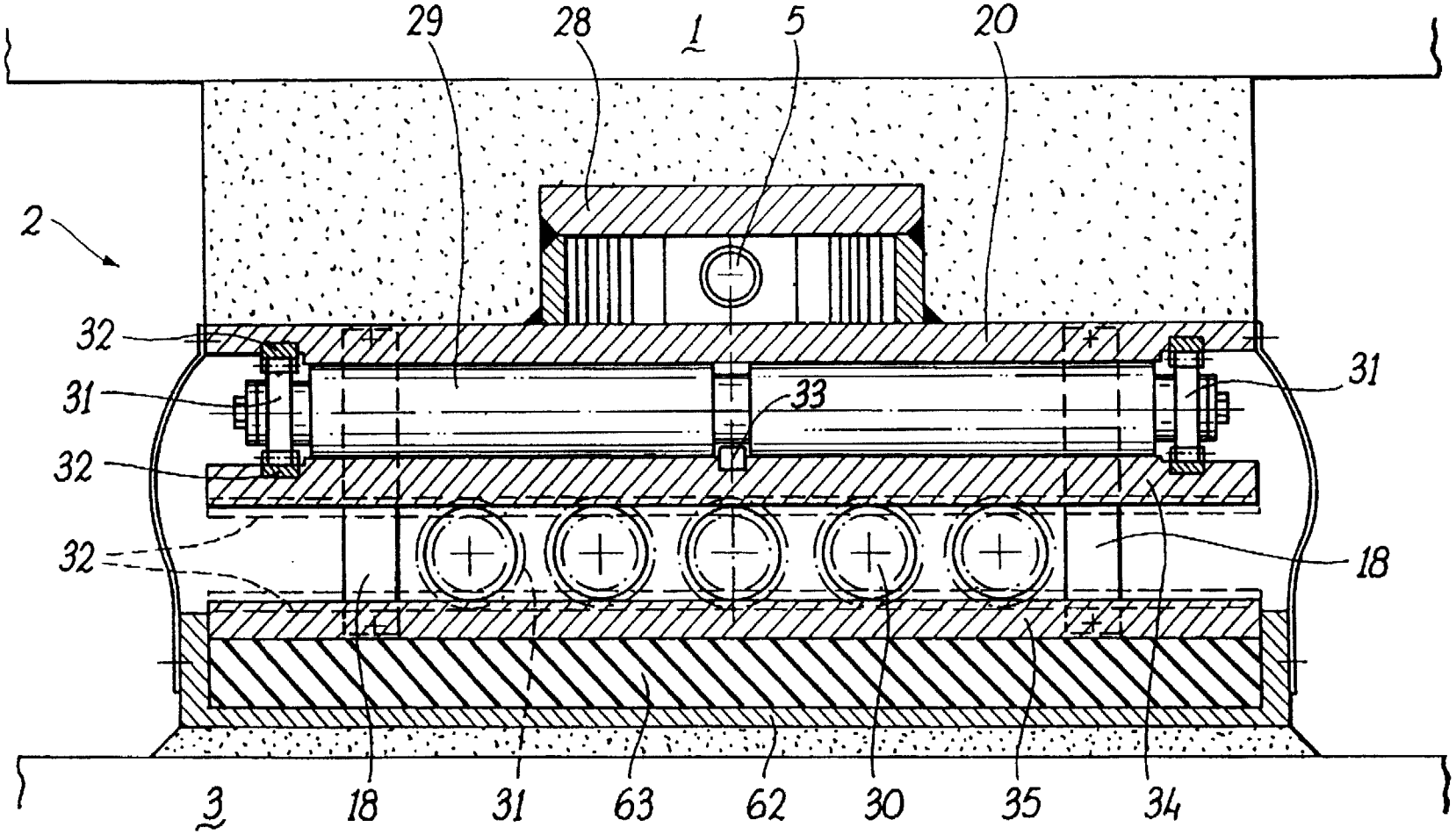

As it can be particularly observed in FIG. 4a (vertical cross-section along line 4a—4a of FIG. 4), the upper portion of abutment 2 comprises a box 28 containing the return rope 5 terminating with head 4 and integral with plate 20.

Plate 20 defines the upper limit of a room housing a first set of rollers 29, parallel to one another, and a second set of rollers 30, orthogonal to the rollers of the first set, designed to carry out running movements by engagement with corresponding racks 32 provided on the upper plate 20, on the central plate 34 and on the lower plate 35 rigidly connected to the pier dosseret through box 62 containing a rubber shim 63, to allow small rotation movements.

The engagement of the rollers with guide racks is not absolutely necessary: in fact, the concerned rollers can also easily be guided by means of grooves provided therein and engaged with feathers provided on said plates. Anyway, engagement with racks is more adapted to enable an even and accurate relative running movement.

The attachment head 4 of the return rope 5 comprises a protection metal box 22 containing metalshock shims 23, a spherical hinge 24 with its seat 25, a self-locking nut 26, a contrast rubber shim 27; said metal box 22 having a rubber cover shim 21 glued thereupon.

Rolling movement of rollers 29 and 30, as above mentioned, is guided by engagement of pinions 31 arranged at their ends with corresponding racks 32, while a tang 33 prevents them from laterally shifting.

The upper plate 20 and the lower plate 34 that contain the first set of rollers 29 are assembled together by means of a programmed strength pin 17, which is designed as to prevent any transversal relative movement between the bridge deck structure and the pier in normal operation.

The contrast elements provided on the support or abutment apparatuses are of two kinds: bar elements 18, four elements in each apparatus, exclusively useful in the transport and assembling steps, which are successively removed according to the manufacturing steps of the bridge deck structure; and pin elements 17, one for each apparatus, designed so as to prevent any transversal relative movement of the apparatus by resisting, with a pre-established safety tolerance, the transversal actions caused by the wind and by the centrifugal force during normal operation. During a seismic event, when the transversal components of the seismic forces are higher than the forces developed during normal operation, the above said pins are sheared, thereby enabling also the transversally acting aseismatic devices to operate according to the above described principles.

All abutment apparatuses are provided with contrast pins 17 designed to prevent, during the normal operation, any transversal relative movement between the piers and the deck structure as caused by wind and centrifugal forces; while any longitudinal relative movement caused by slow deformations and/or by braking is not prevented by pins, but by said aseismatic devices themselves, arranged upon piers 1", 3", 5", 7", 9", which act in longitudinal direction. When a seismic event occurs, under the effects of the longitudinal seismic components, the aseismatic systems arranged at 1", 3", 5", 7" and 9" can immediately become operative and the piers (all of the piers) can freely oscillate along the bridge deck structure longitudinal axis, without coupling significant force pulses thereto. When, under the action of the transversal seismic components having values corresponding to the programmed resistance threshold, the contrast pins of the abutment apparatuses of the various piers are broken, also the transversal aseismatic devices provided on piers 2", 4", 6" and 8" become successively operative, thereby enabling the piers to oscillate also in transversal direction.

Figure 4C:
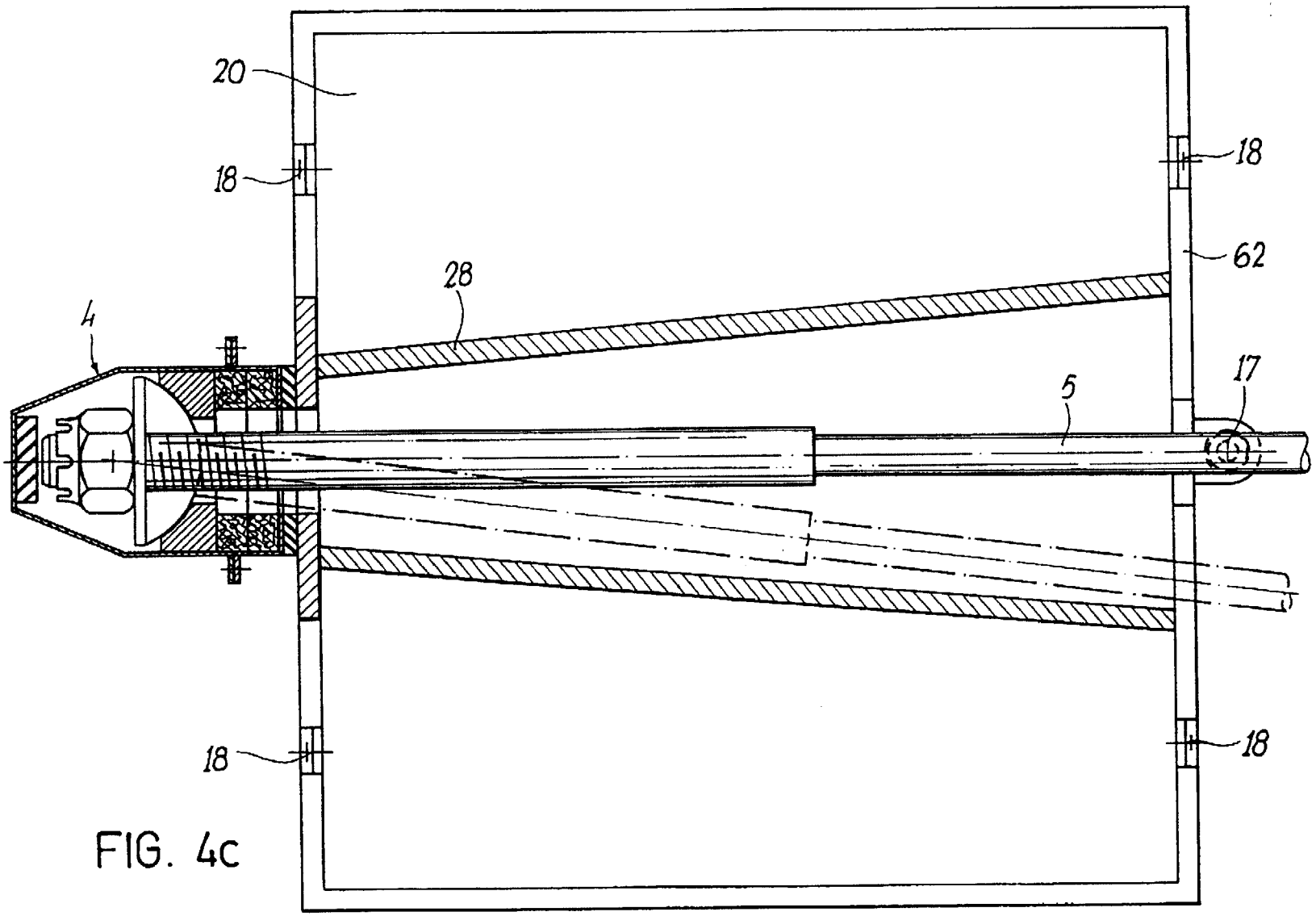
Figure 4D:
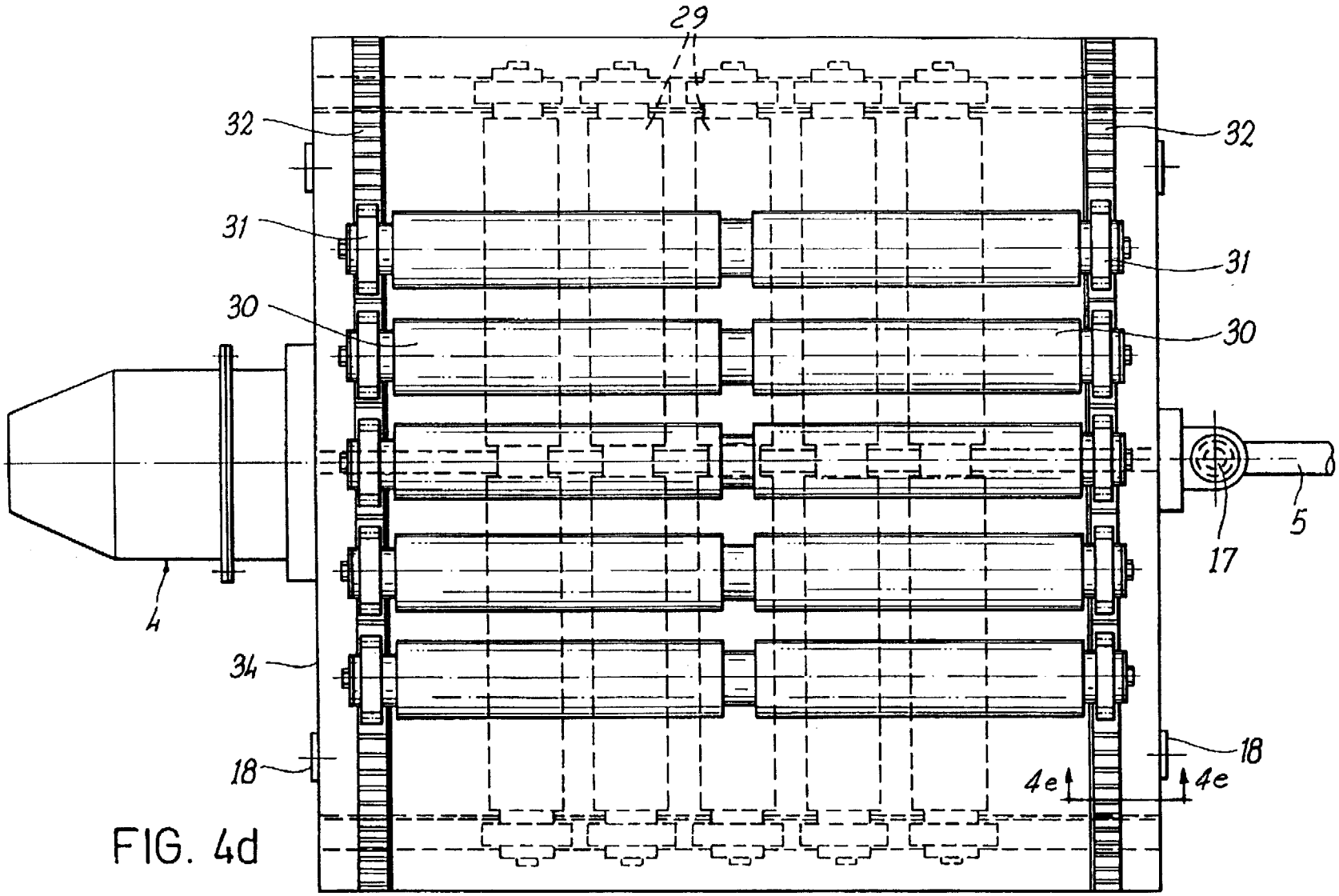

FIG. **4*b* shows a vertical cross-section view along line 4*b*—4*b* of FIG. 4 of abutment unit 2 shown in FIG. 4, while FIG. 4*c* (taken along the line 4*c*—4*c* in FIG. 4*a***) shows a plan section view of the abutment apparatus, as well as the seat within which the return rope can move when it becomes operative under the effects of the seismic event.

Figure 4E:
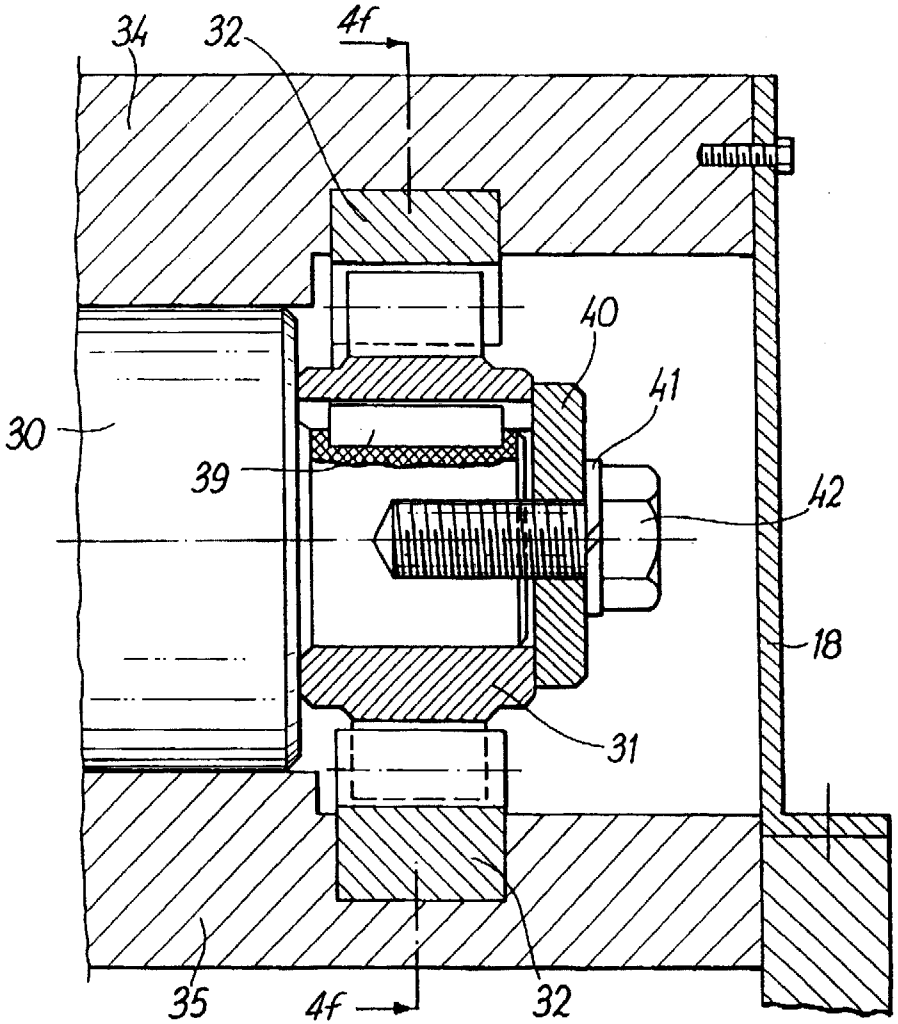
Figure 4F:
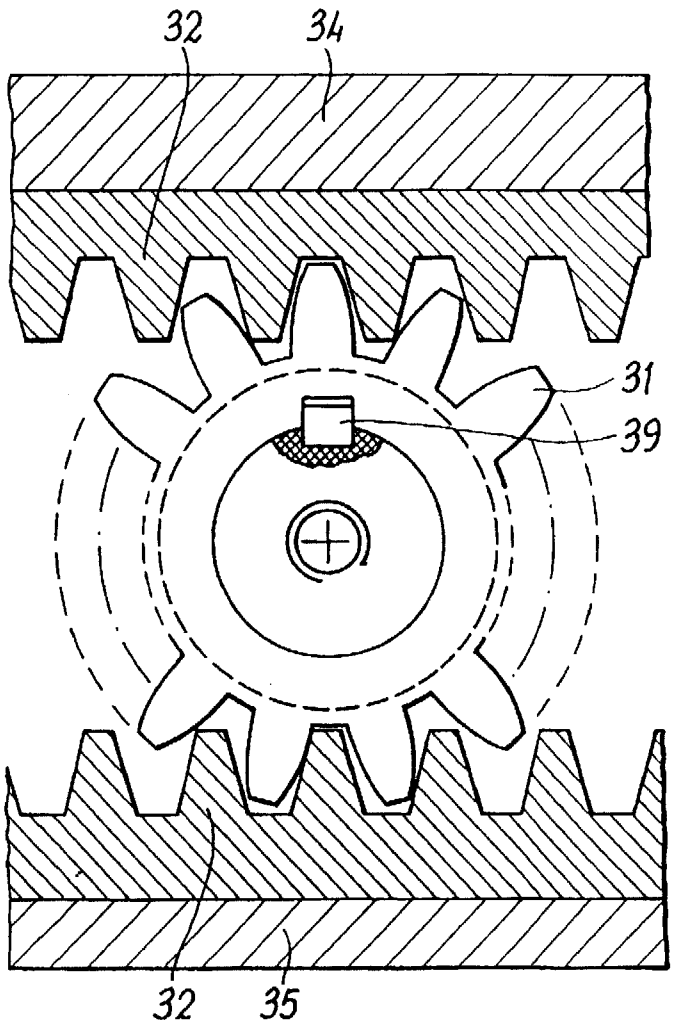

FIG. **4*d* (taken along the line 4*d*—4*d* in FIG. 4*a*) on the other hand shows a plan view of the roller arrangements 29 and 30 having at their ends pinions 31 and racks 32, while in FIGS. 4*e* (taken along the line 4*e*—4*e* in FIG. 4*d*) and 4*f* (taken in the direction 4*f* in FIG. 4*e*), which illustrate a detail of the pinion-rack coupling, it is possible to observe the central plate 34, the longitudinal roller 30, the base plate 35, the pinion 31, the racks 32, the tang 39 that integrally connects roller 30 with pinion 31, a containment and distribution washer 40, a resilient washer 41, a connection screw 42**.

It can be noted from the above arrangement that, aiming at preventing the rollers to slide upon the plates, the pitch circumference of the pinion-rack assembly coincides with the rolling plane of the roller upon the plate.

FIGS. 5 and **5*a* show the abutment apparatus 2A which is adopted when the return force acts in parallel direction to the dry bridge axis, namely in correspondence to piers 1", 3", 5", 7", 9". It is apparent that, in this embodiment of the abutment apparatus, the metal box 28 containing the return rope 5 is not integrally connected to the multi-directional block comprising the first and the second set of rollers 29A and 30A, orthogonally arranged between the upper plate 20A, the central plate 34A and the lower plate 35A, said plates 20A and 34A being integrally connected by means of said contrast pin 17A** for normal operation.

In view of this arrangement, the pier top portion, which is subjected to transversal forces of higher value with respect to the design values which pin 17A should withstand, is enabled to freely move with respect to the deck structure in orthogonal direction to its longitudinal axis.

FIGS. 6 and 6A show the anchorage system for attaching the return rope 5A to the bridge deck structure 1, in respect of the abutment arrangement shown in FIGS. 5 and **5*a***, with a return force acting in a direction parallel to the longitudinal axis of the deck structure.

Shims or spacers 44, to be inserted during the development of slow deformation of the deck structure, are provided within the anchorage box 43 within which the head 4A of rope 5A runs.

Figure 8:
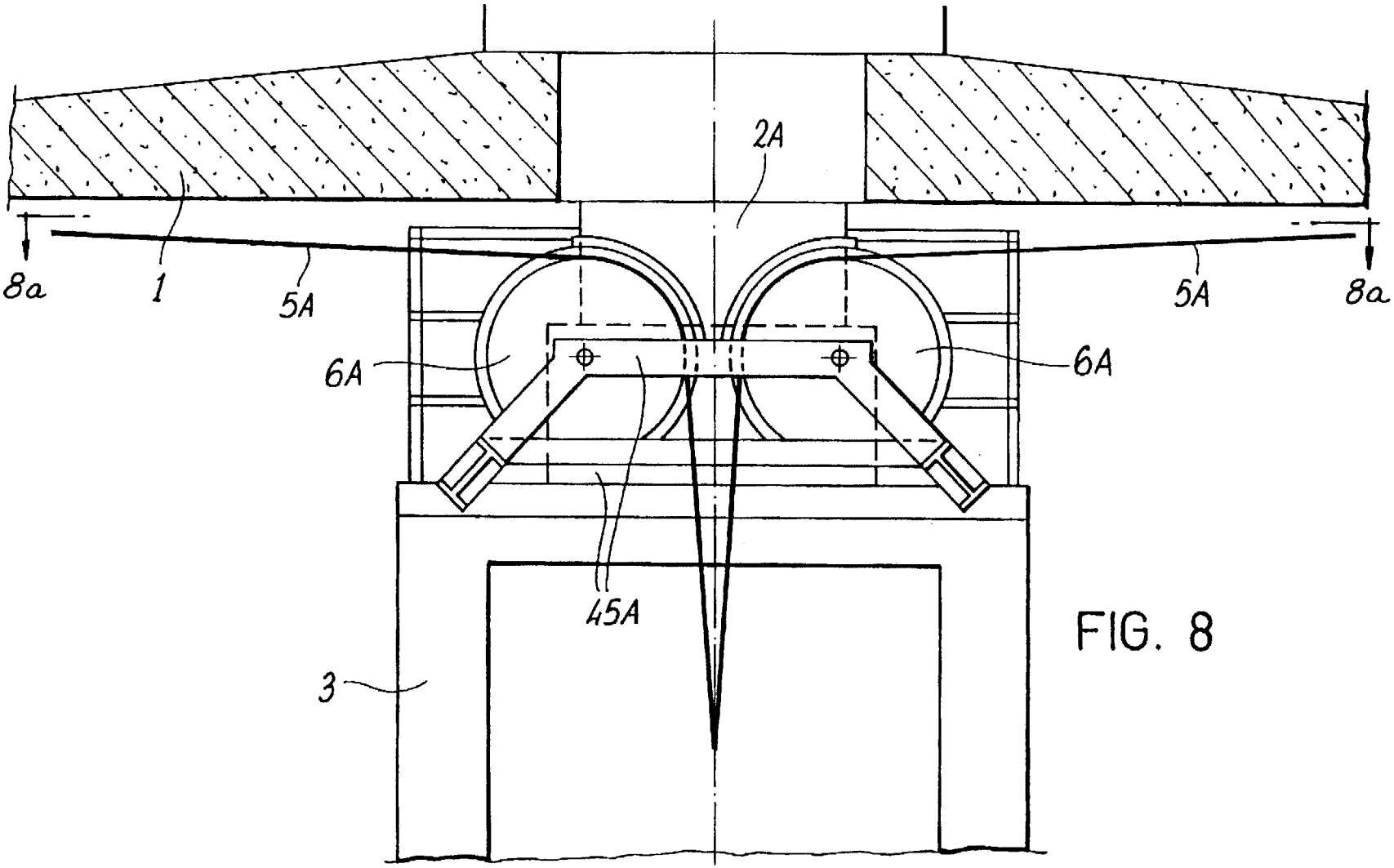
Figure 8A:
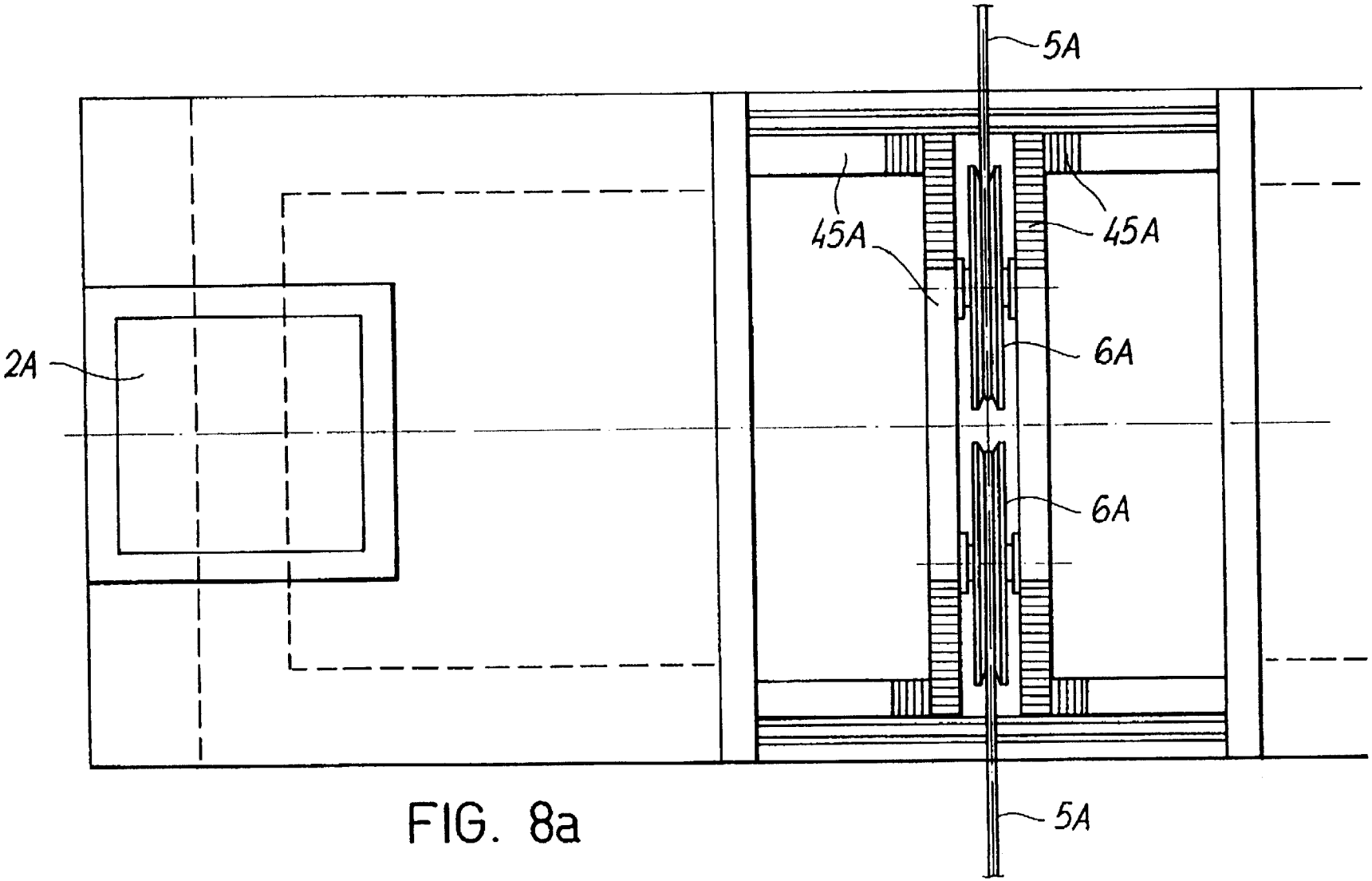

As concerns the connection between the head 4 of the return rope 5 and the assembly of return mechanisms, it is possible to note in FIGS. 7 and **7*a*, in side and top plan view, respectively, a possible embodiment of the support frame 45 for pulleys 6, when the return force acts in orthogonal direction to the longitudinal axis of the dry bridge, while FIGS. 8 and 8*a* illustrate the support frame 45A for pulleys 6A** when the forces act in parallel direction with respect to said longitudinal axis.

A possible embodiment of the mechanism assembly designed to generate the return forces is illustrated in FIG. 9, **9*a* and 9*b*** in its whole and in detail.

By particularly referring to FIGS. 9 and **9*a*, it is possible to note counterweight 11 as controlled by ropes 5 coming from pulleys 6, the terminal sleeve 47, a thimble 48 for receiving a loop 49, brackets 7 for connecting said thimble with the lower pulley, a third rope 10, a rope terminal 51 for attaching a counterweight 11, an equalizer 52 for balancing the loads acting upon the springs, the anchorage support 13 to the body of the pier 3, channels 53 for connecting the anchorage support 13 to pier 3, the anchorage support 54 to counterweight 11, channel members 55 for connecting said support to the counterweight 11, the external guides for regulating the movements of the counterweight, the sliding shoes 57 for enabling the counterweight to slide upon the external guides, the internal guides 58 which regulate the movement of the assembly comprising the above said thimble 48, the brackets 7 and the pulley 8 with respect to counterweight 11, the sliding shoes 59** for enabling the above said assembly to slidingly move upon the internal guide.

FIG. 10 shows the assembly thimble 48 - brackets 47 - pulley 8 when the return system is arranged parallel to the longitudinal axis of the bridge with the thimble 48 arranged at 90° with respect to said pulley 8.

The operation of said return block 11 is the same both when ropes 5 are extended in orthogonal direction with respect to the axis of the bridge deck structure and when they extend in parallel direction. In both cases, a force is always acting upon the third pulley 8, said force, when the weight of the block is F, having twice such value, namely 2F. This force, when the structures are not biased by horizontal actions (FIG. 11 ) is again divided into two equal forces F which act upon the deck structure and balance one another. When, for any reason (braking or seismic event, in respect of devices having the ropes parallel to the deck structure axis, or seismic event in respect of devices having the ropes orthogonal to said axis), a relative displacement is caused between the deck structure and the related pier (FIG. 11*a*), the balanced condition is no more existing and a force of 2F value is transmitted to the deck structure by a single rope and in a direction opposite to the displacement direction, while the other rope is unloaded. The return block could also be attached to the junction of said two ropes 5, but said third pulley 8 is provided just to halve the block weight, when the traction forces acting upon said ropes 5 are equal, thereby permitting smaller and less encumbering blocks and related damping springs to be adopted. The distance between pulley 8 and block 11 should at least be equal to twice the relative displacement foreseen between the bridge deck structure and the pier with a tolerance gap. In fact, when the pulley moves upwardly by x, the block moves by 2x.

According to a further suggestion of the aseismatic system as provided by this invention, it ought to be applied to buildings manufactured in seismic areas.

In this case, the problem is no more to clear the bridge deck structure from its piers, but to clear the building from its foundations.

The foundation, which is an almost rigid structure, will oscillate together with the ground and the building, which is not rigidly connected therewith, but is connected only by means of said return system, will be subjected to much smaller and slower displacements, and it will stop after a few oscillations.

Figure 12A:
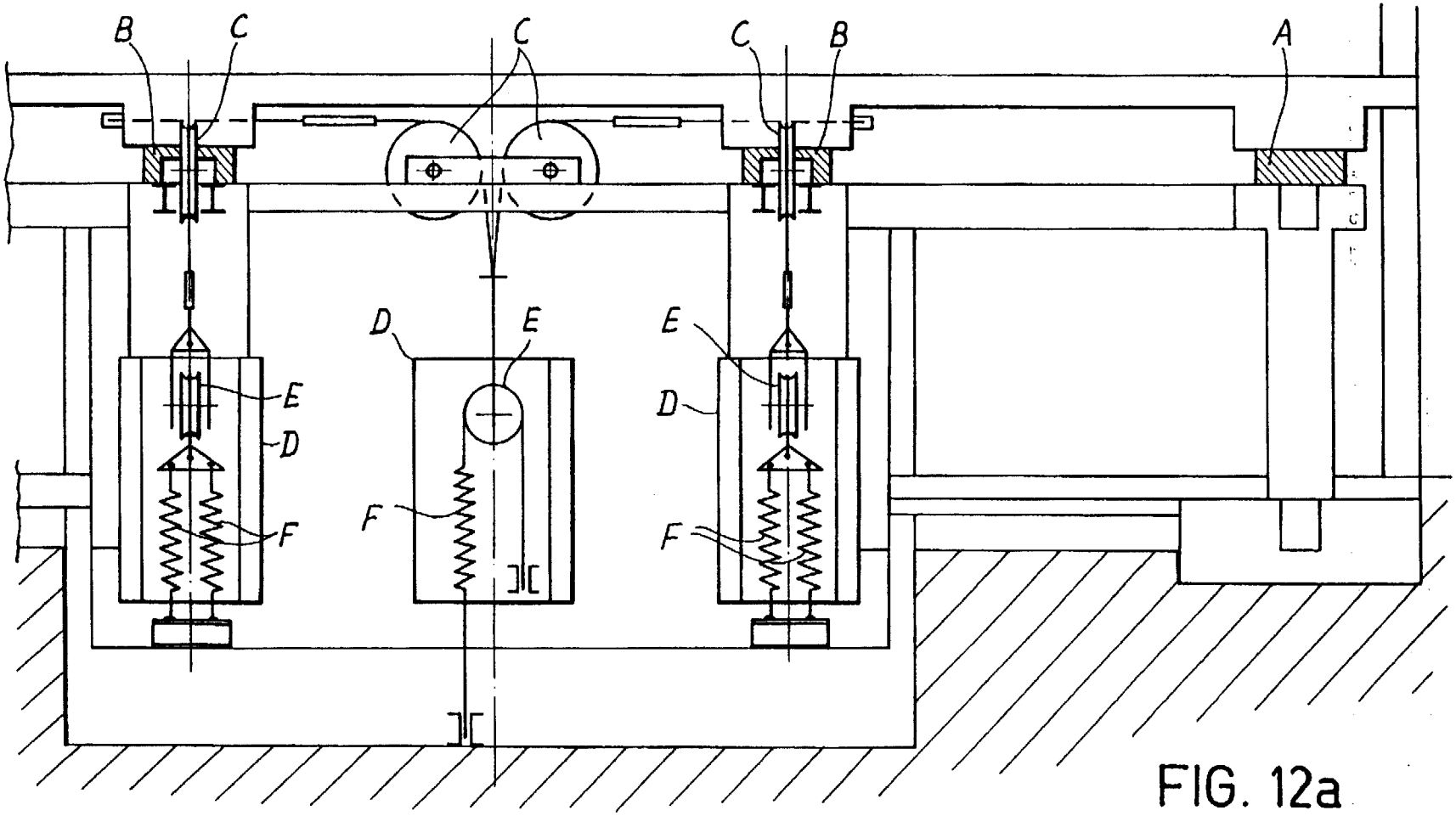
Figure 12B:
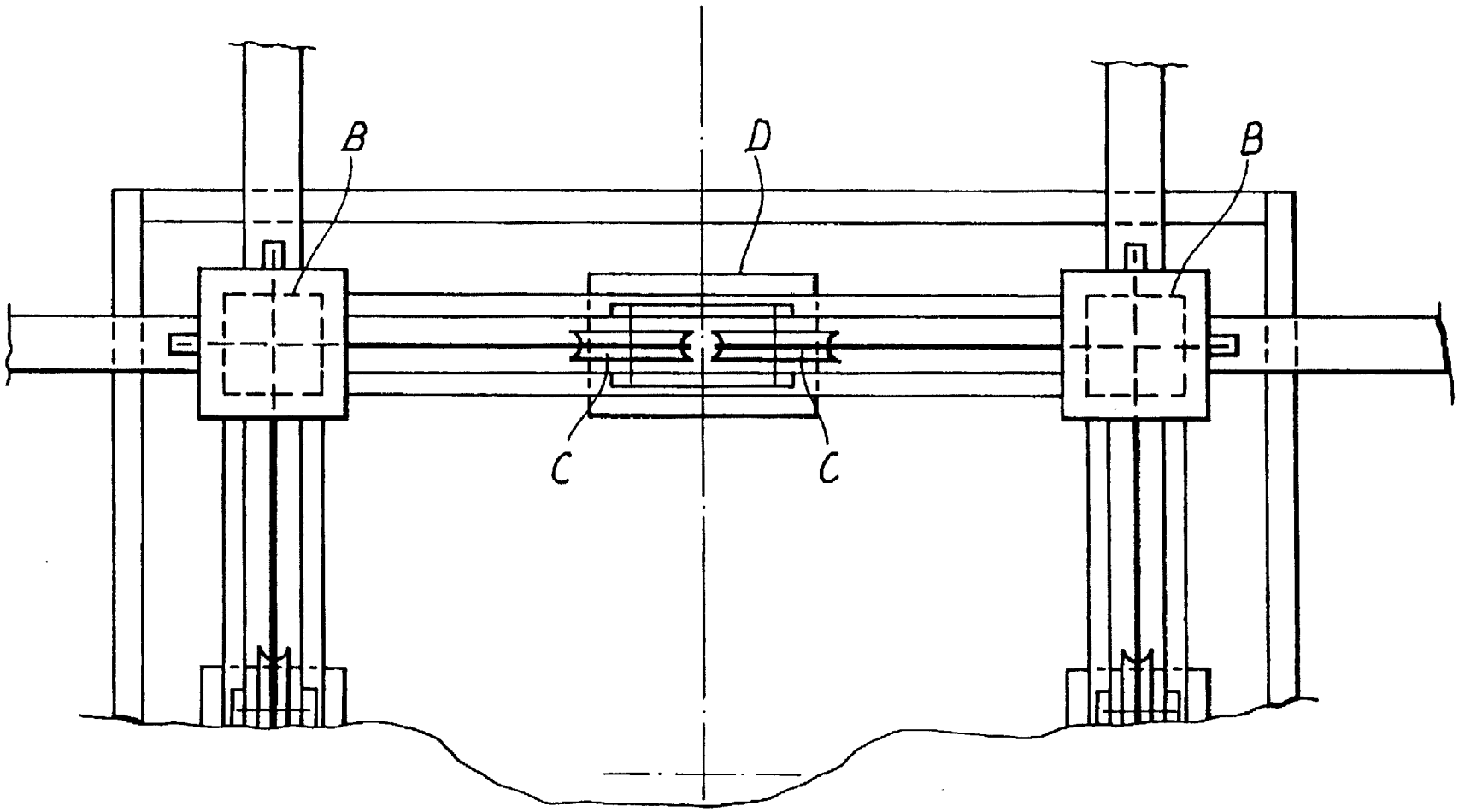
Figure 12C:
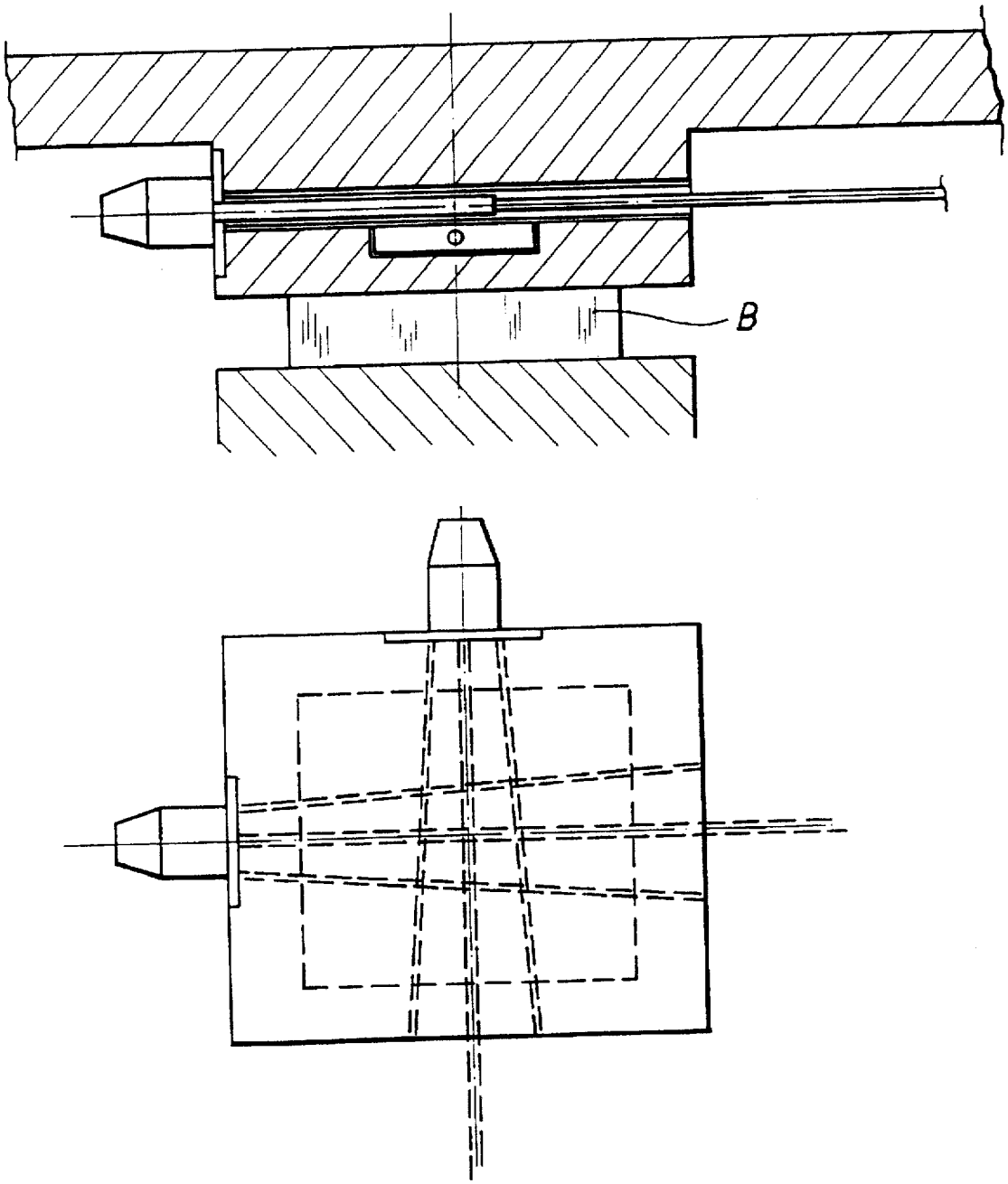

By referring to FIG. 12 and more detailedly to FIGS. 12*a*, 12*b* and 12*c*, they schematically show a possible arrangement of the apparatuses comprising the multi-directional abutments and of the return system as related to a building. In these Figures, A designates the multi-directional abutments of a kind illustrated in FIGS. 5 and 5*a*, which have no return ropes associated thereto, B designates abutments equal to the previous ones but associated to return ropes, C designates the upper relay pulleys, D designates the counterweight, E designates the lower anchorage pulley and F designates a damping spring.

As far as the aseismatic device according to this invention is concerned, comprising a decoupling and abutment system as well as a return system, the component parts of the return system, substantially comprising resilient spring means and gravimetric contrast means, can be associated with one another also in different manner as previously described, both the function and the final results being unchanged. By way of exemplification, a second and a third embodiments thereof are illustrated and these further embodiments could be preferred with respect to the already described one, when the specific characteristics of any single building so requires.

A further way to associate said resilient spring means and said gravimetric contrast means with one another is the one wherein the springs operate by compression rather than by extension, wherein said springs are centrally housed within the counterweight and have their upper portion in contrast with the inner top of the counterweight and their lower portion in contrast with a cylindrical base plate, which is vertically slidable with respect to said counterweight, wherein said plate is connected to an upwardly slidable steel rope for insertion into a pulley which turns it by 90°, wherein said rope with its downwardly directed run extends through a suitable recess of said counterweight and is anchored to the pier body by means of metal beams, wherein said pulley is equipped with bracket means and with a thimble for attachment of second rope means having shapes and functions as in the first above described embodiment.

FIGS. 9*c*, 9*d*, 9*e* show in plan and cross-section views this second way for associating the springs with the counterweight. By referring to said Figures, it is possible to note the springs 12A, the counterweight 11A, the cylindrical base plate 60, the rope 10A for connection to the pier body, the pulley 8A, second rope means 5, the vertical guides 58A which cooperate with said shoes 57A to regulate the operation of the pulley 8A and of the thimble 48A, as well as the metal beams 53A for connection to the pier body.

A third way to associate said resilient spring means and said gravimetric contrast means is the one wherein the relay pulley 8 is omitted, which allows to halve the counterweight mass and in this manner a volume and a mass are needed of twice the possible value of the first and second above described association embodiment and wherein springs are employed operating by compression, centrally housed within the counterweight, with their upper portion in contrast with the inner top of the counterweight and their lower portion in contrast with a cylindrical base plate, which is slidable with respect to the counterweight, wherein said plate is connected to a steel rod by means of an articulated joint equal to the articulated joint provided on the above described abutment/decoupling means, wherein the upper end of said rod is connected by a thimble means to rope means having shapes and functions as in the first above described embodiment.

FIGS. 9*f*, 9*g*, 9*h* show in plan and cross-section views this third way to associate said resilient spring means with said gravimetric contrast means.

By referring to said Figures, it is possible to note the springs 12B, the counterweight 11B, the cylindrical base plate 60B, the steel rod 61, the articulated connection joint 56B, and the metal beams 53B for connection to the pier body.

EXAMPLES

1. DRY BRIDGE. NORMAL OPERATION.

As regards any slow deformations due to shrinkage and/or viscosity, if any, which, as to their significant fraction, are absorbed in nearly one year time, it will be sufficient to adjust a couple of times, by means of suitable shims, the connections of the ropes extending parallel to the longitudinal axis of the bridge deck structure in correspondence to the piers 3 and 7, in order to eliminate any small backlash generated therebetween;

as regards any slow deformations due to thermal variations, which have daily and seasonal cycles, the ropes parallel to the longitudinal axis of the deck structure resting upon piers 3 and 7 will be in free-standing condition and under tension in symmetrical way with respect to the girder centre. The centre point of the girder, under the symmetrical and balanced force systems generated by any deformation of thermal origin, will be stationary, except for possible longitudinal microdisplacements that could be caused by any small difference in the rolling resistance of the abutment apparatuses;

as regards the braking, assuming that it occurs with maximum temperature, the piers 3" and 7" will have the ropes extending to the girder centre in free-standing condition and the opposite ropes under tension, with displacements at said piers, as caused by temperature variations, of about 1.6 centimetres and with balanced force system generated by the return mechanisms; therefore, the sole force adapted to contrast the braking, in absence of girder displacements other than the thermal ones, will be the force generated by friction in the abutment apparatuses and in the pulley connections; force R the value of which can be about 0.2% of the supported weight, namely R=8×1000×0.2%=16 tons to which 2 tons are to be added due to pulley connections and to rounding off to a total of 18 tons.

The roles of forces and displacements in the various braking situations are examined under the assumption that the return system comprises 8 ton counterweights and therefore a traction force of 16 tons in the ropes.

a. braking on a single bay

System of counterweights balanced by counterposition of equal forces (FIG. 3*a*): the sole resistance R in respect of a displacement of the deck structure is the one due to friction in the abutment apparatuses; the braking force F amounts to 12 tons (according to Italian Standards) and the resistance on the abutments R=18 tons, and then R>F and the girder is stationary;

b. braking on two bays

F=12×12=24 tons, R=18 tons, then F−R=6 tons, which aim at displacing the deck structure along the braking direction; as soon as the girder begins to move, the situation illustrated in FIG. 3 takes place and an additional resistance is introduced correspondent to tension of two ropes parallel to the longitudinal axis of the bridge deck structure; resistance R becomes R=18 30 2×16=50 tons, then R>F and the girder remains effectively stationary;

c. braking on three bays.

F=3×12=36 tons, R=50 tons, then R>F and the girder effectively remains stationary;

d. braking on four bays.

F=4×12=48 tons, R=50 tons, then R>F and the girder effectively remains stationary;

e. braking on five bays.

F=5×12=60 tons, R=50 tons, then F>R and the girder begins to move; when a displacement of 1.6 cms occurs, namely the thermal displacement at the piers 3" and 7" the situation becomes the one illustrated in FIG. 3, namely resistance R amounts to R=18+16×4=82 tons, then r>F and the girder stops after a 1.6 cm displacement in the braking direction;

f. braking on six bays.

F=6×12=72 tons, R=82 tons, then R>F and the girder stops after a 1.6 cm displacement in the braking direction;

g. braking on seven bays.

F=7×12=84 tons, R=82 tons, then R=F and the girder stops after a 1.6 cm displacement in the braking direction;

h. braking on eight bays.

F=8×12=96 tons, R=82 tons, then F>R and the girder begins to move; when a displacement a bit greater than the thermal displacement of 1.6 cms takes place at the piers 3" and 7", the girder contacts a movable shim arranged upon the dosseret corresponding to thermal expansion joint which, as above said, is effectively closed and softly rests upon the subsequent girder; when it is desired to renounce this approach, it is sufficient to increase said counterweight by 2 tons in order to achieve R=18+20×4=98 tons, thereby obtaining R>F, and in this situation it is assured that the girder stops after a 1.6 cm displacement in the braking direction.

As concerns the wind, by referring to the dry bridge previously considered diagram, the action of the wind V on each bay is evaluated by assuming a bay structure in prestressed reinforced concrete the height of which is 1/18 of the span plus the kerb thickness, namely h=40/18+0.20=2.44 meters, then (according to Italian Standards and assuming the maximum seismic event and a wind acting in orthogonal direction to the girder along its whole extension of 320 meters) V=40×2.44×0.25=24 tons per bay; this force, minus the rolling friction force of the abutments amounting to about 2 tons, is reduced to 22 tons per bay. Since each abutment apparatus is provided with a pin adapted to resist transversal movements and since two apparatuses are used for each pier, each contrast pin will be subjected to a shear force amounting to 11 tons; as the bay span value is decreased, the wind action at least linearly decreases, while the counterweight, that is proportionate in relation to the braking effect, will remain constant, so that, for bay spans amounting to less than 25 meters, it will not be necessary to adopt contrast pins, in view of the fact that the sole counterweights will be sufficient to resist the action of the wind.

As alternative, the following approach can be adopted to resist the wind action: the contrast pins are arranged only on those abutments belonging to the piers provided with return traction means acting in parallel direction to the longitudinal axis of the bridge; as concerns piers provided with return traction means acting in orthogonal direction to the bridge longitudinal axis, the concerned pin will be positioned under the counterweight rather than on the abutment members. From a view point of the seismic effects, the contrast pins are advantageously divided into two classes: a first class (pins arranged upon the abutment members) comprises pins having a rigid behaviour, a second class (pins arranged under the counterweight) comprises pins having a more resilient behaviour due to presence of springs. This means that, during a seismic event, the programmed breakage of the more rigid pins will advantageously precede the breakage of the pins having a more deformable behaviour. In normal operation, on the other hand, since the wind can be considered as a statically acting force, the pin will all together furnish their contribution to resistance. The distribution of the forces under the wind effects, by this alternative approach, becomes as follows:

for pins of the first class: wind action V=22 tons, action on each pin 22/2=11 tons, for pins of the second class: wind action V=22 tons, counterweight contribution 8×2=16 tons, action on each pin (22−16)/2=3 tons.

2. DRY BRIDGE. OPERATION UNDER SEISMIC ACTIONS.

FIG. 1 shows the behaviour of a continuous eight bay dry bridge under the effects of a seismic event.

The piers of the dry bridge can be divided into two kinds:

piers wherein the return rope system is orthogonally arranged with respect to the dry bridge axis, piers wherein the return rope system is parallel to the dry bridge axis.

Component of the seismic action parallel to the longitudinal axis of the dry bridge.

The piers of the first kind do not transmit significant actions to the bridge deck structure, so that each pier can freely oscillate in a direction parallel to the longitudinal axis of the dry bridge, thereby remaining subject only to the inertial force due to its own mass; the piers of the second kind transmit a longitudinal force to the bridge deck structure, the maximum value of which can be compared to the traction force T as developed by the rope, which traction force will be equal to twice the value of the dynamically increased counterweight, namely T=2×8+rounding off=18 tons.

in sizing the piers, then, this horizontal force acting in a direction parallel to the dry bridge axis should be considered only in respect of the piers of the second kind; the piers of the first kind, on the other hand, as above said, are free from horizontal actions of seismic origin, applied to their tops and acting in a direction parallel to the longitudinal axis of the bridge.

Component of the seismic action orthogonal to the longitudinal axis of the dry bridge. Each pier is adapted to transmit to the bridge deck structure a horizontal force F orthogonal to the longitudinal axis of the dry bridge, the maximum value of which is determined by the strength of the contrast pins; in other words, a force equal to the wind action plus an additional increase corresponding to the safety coefficient adopted in respect of the shear strength of the pins. This force in the exemplified dry bridge amounts to F=1.2×22=27 tons per bay.

It can be concluded that the horizontal actions of seismic origin acting on the top of the piers are not greater than those expected for normal operation.

According to the suggestion of this invention, the programmed breakage of the contrast pins during a seismic event (which enables the piers to clear from the deck structure and causes the return system to operate) occurs under action of much lower forces (about ⅕) than those generated by the deck structure, should it remain connected to the pier; in other words, the operation of the described safeguard system begins when the seismic event still develops very low force values and under still small oscillations of the piers. Furthermore, the breakages of the contrast pins will not be contemporaneous because the mutual action between the deck structure and the piers will be different in respect of the various piers, both in view of the differences between the pulses the various piers receive from the ground and in view of the different height and stiffness of the piers and in view of the curvature of the layout and of the random behaviour of each pin, and in view of the different stiffness of the pins, when the approach is adopted providing for the pin to be alternatively arranged upon the abutment member and under the counterweight. This means that the oscillations of the piers and of the bridge deck structure connected thereto, when the return system begins to operate, are even smaller because, as the pins are broken, the interactions pier-deck which drive the assembly into oscillation are eliminated.

Comparison between the oscillation period of the oscillator consisting in the deck structure and in its return system and the oscillation period of a single pier, taking again the girder of FIG. 1 as an example.

It is assumed that, when the return system begins to operate, the displacement S of the pier top portions is of about ±10 cms and that the corresponding oscillation period is of 1 sec, this value being near to the effective values and anyway cautiously chosen. Each return system is related to the mass of two bays and the magnitude order of the oscillation period of the return system can be defined as follows:

| | |
|---|---|
| Return force F | F = 16 tons |
| Mass M of two bays | M = 1000 × 2/9.81 = 204 tons |
| Acceleration a = F/M | a = 16/204 = 0.078 m/sec$^2$ |
| Time t needed to run a length s | t = √2 × s/a = √2.56 = 1.6 secs |
| Oscillation period T | T = 4t = 6.6 secs |

The oscillation period of the return system is more than 6 times the oscillation period of a pier, which assures an absolute effectiveness of the filter action exploited by the return system.

Provisions for restoring the aseismatic system.

After a seismic event capable to activate the oscillating return system, it is necessary to restore the wind contrasting pins. Before such an intervention becomes effective, the wind action is anyway contrasted by said counterweights which are able by themselves to absorb a noticeable portion thereof.

3. BUILDINGS

By referring to the structural diagram illustrated in FIG. 12, it can be seen that Weight p of the building (6 floors), P=2500 tons Rolling resistance R of the abutment apparatuses, R=2500×0.2%=5 tons Return force F assumed as 5 times R, then F=5×5=25 tons.

According to the diagram of FIG. 12, four counterweights are provided, adapted to develop mutually orthogonal tension forces. Since a tension force of 25 tons has been designed for either one of said two directions and a return system is provided for each direction, each system should generate a tension force of 12.5 tons: the value of the counterweight, therefore, will be a bit greater than 6 tons.

For normal operation, it is necessary to balance the wind action, the magnitude order of which is defined by V=20 m×18 m×0.15 tons/square meter=54 tons.

When a contrast pin is provided for each abutment apparatus, pins having a programmed breakage point around 54/16+rounding off=4 tons are used.

When the seismic force reaches this value, cumulatively 16×4=64 tons, the pins are broken and the return system begins to operate.

In this way, the building that, in a seismic area of 1st Class, should be sized under consideration of a horizontal force of 2500×0.1=250 tons, can be sized under consideration of a horizontal force four times smaller.

We claim:

1. As aseismatic system for supported structures such as buildings, dry bridges and tanks carried by supporting structures such as foundations and piers, characterized in that said system comprises abutment/decoupling means for disposition between a supported structure and a supporting structure for operatively and supportively coupling the supported structuring on the supporting structure, and being responsive to a seismic event for decoupling the supported structure from the supporting structure, and return means including rope means connecting said return means to said abutment/decoupling means for resisting relative displacements between the supported structure and the supporting structure upon decoupling of the supported structure from the supporting structure at said abutment/decoupling means with a force of constant value independent of said relative displacement.

2. An aseismatic system according to claim 1, wherein said abutment/decoupling means comprise superimposed plate means for connection to the supported structure and the supporting structure, respectively, such plate means defining first and second parallel and superimposed recesses, and first and second roller sets respectively housed within said first and second parallel recesses.

3. An aseismatic system according to claim 2, characterized in that said first and second roller sets are orthogonally arranged.

4. An aseismatic system according to claim 2 or 3 characterized in that said abutment/decoupling means define a third recess superiorly arranged with respect to said first and second recesses, said third recess being bound by the one of said plate means for connection to the supported structure and receiving said rope means.

5. An aseismatic system according to claim 4 wherein said third recess is provided with means for retaining said rope means.

6. An aseismatic system according to claim 2 or 3 characterized in that said plate means are interconnected with each other at their ends by attachment/contrast pin means.

7. An aseismatic system according to claim 2, wherein said rollers are provided at their ends with pinions meshed with corresponding racks provided on said superimposed plate means.

8. An aseismatic system according to claim 1 wherein said return means comprise resilient spring means, counterweight means of predetermined weight, said resilient spring means having a lower end for attachment to the supporting structure and an upper end connected to said counterweight means by first rope means slidably extending through pulley means, and thimble means connected to said pulley to said abutment/decoupling means by second rope means received in recesses in said abutment/decoupling means.

9. An aseismatic system according to claim 8 wherein said counterweight means are adapted to be arranged under the supported structure in symmetrical position with respect to said abutment/decoupling means so that, when said return means is in balanced position, each of said first and second rope means received by and attached to said abutment/decoupling means is acted upon by a force equal to the weight of said counterweight means.

10. An aseismatic system according to claim 9, wherein the force acting upon said resilient spring means is equal to the weight of said counterweight means.

11. An aseismatic system according to claim wherein said counterweight means, said pulley means and said resilient spring means have guides to prevent transverse movement with respect to the supporting structures.

12. An aseismatic system according to claim 11, characterized in that said resilient spring means have equalizer means at their upper ends balancing loads applied to said spring means.

13. An aseismatic system according to claim 12, characterized in that said resilient spring means and said counterweight means are associated with one another by making the spring means operate by extension and by a relay pulley system to reduce forces applied to said counterweight means by said spring means in order to halve the weight necessary for the counterweight means.

14. An aseismatic system according to claim 12, characterized in that said resilient spring means and said counterweight means are associated with one another so as to make the spring means operate by compression and by a relay pulley system to reduce forces applied to said counterweight means by said spring means in order to halve the weight necessary for the counterweight means.

15. An aseismatic system according to claim 12, characterized in that said resilient spring means and said counterweight means are associated with one another so as to make the spring means operate by extension and by utilizing a doubled mass counterweight means.

16. An aseismatic system according to claim 12 characterized in that said resilient spring means and said counterweight means are associated with one another so as to make the spring means operate by compression and by utilizing a doubled mass counterweight means.

* * * * *